US009568190B2

(12) United States Patent
Bertram et al.

(10) Patent No.: US 9,568,190 B2
(45) Date of Patent: Feb. 14, 2017

(54) SYSTEMS, APPARATUS, AND METHODS FOR TREATING WASTE MATERIALS

(71) Applicant: Integrated Energy LLC, Huntington Beach, CA (US)

(72) Inventors: Karen Meyer Bertram, Huntington Beach, CA (US); Dan Watts, Surfside, CA (US)

( * ) Notice: Subject to any disclaimer, the term of this patent is extended or adjusted under 35 U.S.C. 154(b) by 0 days.

(21) Appl. No.: 14/740,069

(22) Filed: Jun. 15, 2015

(65) Prior Publication Data

US 2015/0362182 A1 Dec. 17, 2015

Related U.S. Application Data

(60) Provisional application No. 62/013,436, filed on Jun. 17, 2014, provisional application No. 62/011,903, filed on Jun. 13, 2014.

(51) Int. Cl.

| | |
|---|---|
| ***F23G 5/027*** | (2006.01) |
| ***F23G 5/10*** | (2006.01) |
| ***F23G 5/12*** | (2006.01) |
| ***F23G 5/50*** | (2006.01) |

(52) U.S. Cl.

CPC ..... *F23G 5/0276* (2013.01); *F23G 5/10* (2013.01); *F23G 5/12* (2013.01); *F23G 5/50* (2013.01)

(58) Field of Classification Search

CPC ..... F23G 5/0276; F23G 5/10; F23G 5/12; F23G 5/50

USPC ..... 432/128–130, 133

See application file for complete search history.

(56) References Cited

U.S. PATENT DOCUMENTS

| | | | | |
|---|---|---|---|---|
| 3,972,682 | A | 8/1976 | Stephens et al. | |
| 4,026,264 | A | 5/1977 | Henriques | |
| 4,223,385 | A * | 9/1980 | Miller | F27B 9/40 266/96 |
| 4,255,133 | A * | 3/1981 | Tanifuji | C21D 9/0081 266/80 |
| 4,257,767 | A * | 3/1981 | Price | C21D 9/0081 266/80 |
| 4,606,529 | A * | 8/1986 | Tooch | C21D 11/00 148/511 |
| 4,739,154 | A | 4/1988 | Bharara et al. | |
| 5,411,714 | A | 5/1995 | Wu et al. | |
| 5,636,580 | A | 6/1997 | Kanis | |
| 5,653,183 | A | 8/1997 | Hansen et al. | |
| 5,727,482 | A * | 3/1998 | Young | F23G 5/32 110/235 |
| 6,056,434 | A * | 5/2000 | Champetier | G01J 5/0003 219/411 |
| 6,619,214 | B2 * | 9/2003 | Walker | F23G 5/027 110/101 R |

(Continued)

FOREIGN PATENT DOCUMENTS

GB 766003 1/1957

*Primary Examiner* — Alissa Tompkins
*Assistant Examiner* — Nathaniel Herzfeld
(74) *Attorney, Agent, or Firm* — Fish & Tsang LLP

(57) ABSTRACT

Systems and methods for a pyrolytic oven for processing waste include multiple zones associated with multiple independently-controlled heating sources. The pyrolytic oven may have multiple sensors also associated with each zone. The pyrolytic oven may also include a fuel management system which adjusts a power level of each heating source for each zone independently based on a reading of the corresponding sensor.

9 Claims, 15 Drawing Sheets

(56) References Cited

U.S. PATENT DOCUMENTS

| | | | | |
|---|---|---|---|---|
| 7,000,551 | B2 | 2/2006 | Cole et al. | |
| 7,044,069 | B2 | 5/2006 | Cole et al. | |
| 7,063,528 | B2 | 6/2006 | Klobucar et al. | |
| 7,216,464 | B2 | 5/2007 | Neal et al. | |
| 7,614,388 | B2 | 11/2009 | Wicks | |
| 7,832,343 | B2 | 11/2010 | Walker et al. | |
| 8,328,993 | B2 | 12/2012 | Feerer et al. | |
| 8,419,902 | B2 | 4/2013 | Feerer et al. | |
| 8,835,704 | B2 | 9/2014 | Hornung et al. | |
| 2006/0112639 | A1* | 6/2006 | Nick | C10J 3/08 48/198.1 |
| 2008/0053347 | A1* | 3/2008 | Walker | F23G 5/0276 110/257 |
| 2011/0036706 | A1* | 2/2011 | Van Thorre | C10G 1/02 204/157.15 |
| 2011/0271882 | A1 | 11/2011 | Cole et al. | |
| 2012/0227680 | A1 | 9/2012 | Kerr et al. | |

* cited by examiner

FIG. 11
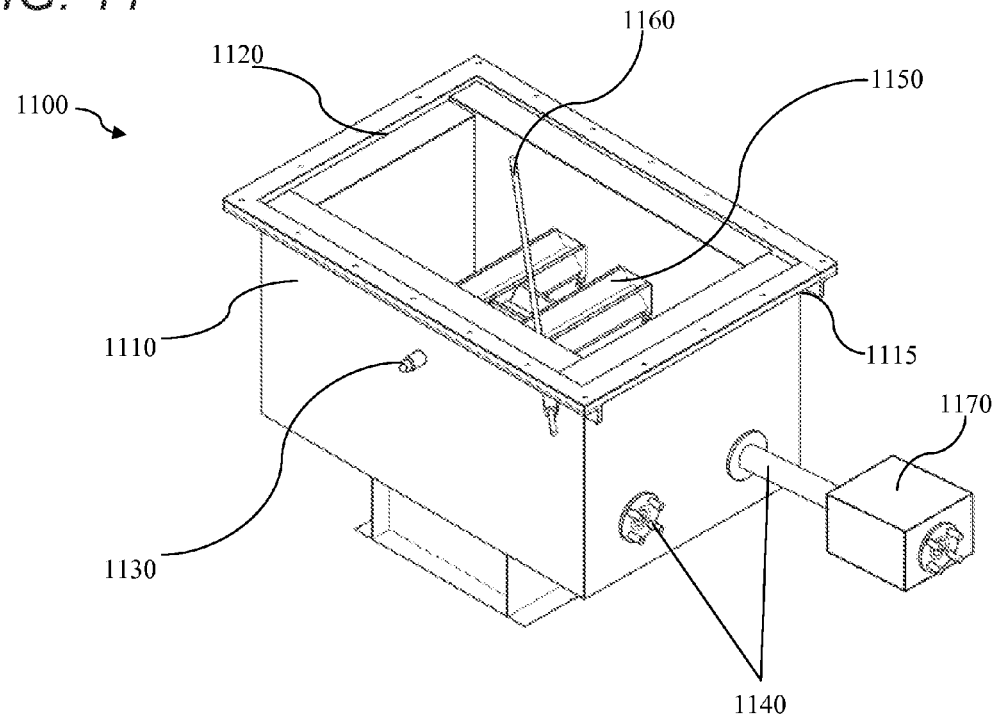
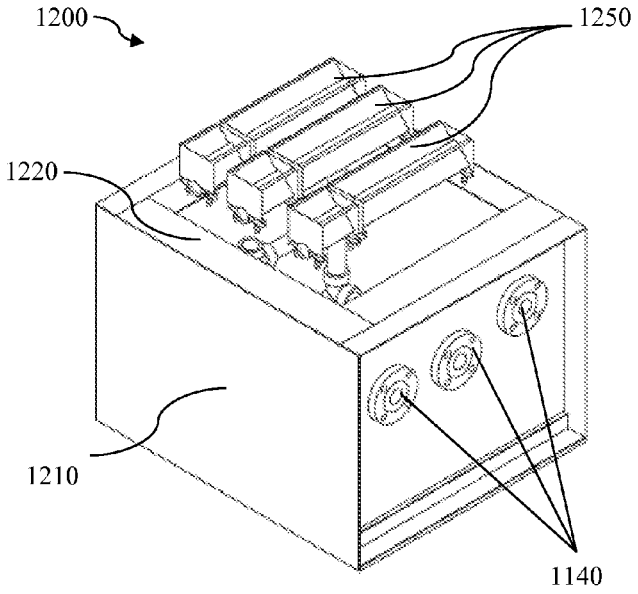
FIG. 12

SYSTEMS, APPARATUS, AND METHODS FOR TREATING WASTE MATERIALS

This application claims the benefit of priority to U.S. Provisional Application 62/013,436, filed Jun. 17, 2014, and U.S. Provisional Application 62/011,903, filed Jun. 13, 2014, the contents of which are incorporated by reference in their entireties. Where a definition or use of a term in a reference that is incorporated by reference is inconsistent or contrary to the definition of that term provided herein, the definition of that term provided herein is deemed to be controlling.

FIELD OF THE INVENTION

The present disclosure relates to pyrolytic ovens and treatment of waste materials in general.

BACKGROUND

The background description includes information that can be useful in understanding the present invention. It is not an admission that any of the information provided herein is prior art or relevant to the presently claimed invention, or that any publication specifically or implicitly referenced is prior art.

Waste management and the creation of renewable energy are common problems in many nations. Pyrolysis, which can be used to turn waste into renewable energy, is one solution to both problems. Pyrolysis involves using high temperatures in a relatively oxygen free environment to decompose waste materials (also known as feedstock) to generate a synthetic gas, or "syngas." The syngas can then be burned to produce renewable energy. Common feedstocks include trash, old tires, and other municipal, industrial, agricultural, or domestic wastes.

Pyrolysis is normally performed using a pyrolytic oven. The pyrolytic oven provides the heat and the necessary environment for pyrolysis to occur. A pyrolytic oven's efficiency is achieved by maximizing the heat transfer from the oven to the feedstock to ensure that the feedstock is completely heated and processed. This can be a challenge because feedstocks can vary greatly in composition and base temperature. In an attempt to increase efficiency, some previous pyrolitic oven designs have sought to improve the way that the feedstock is heated and cycled through the oven. For example, U.S. Pat. No. 6,619,214 to Walker teaches a pyrolytic converter with a screw and paddle conveyor system, which allows the feedstock to be mixed, lifted, and pushed through the pyrolytic oven. U.S. Pat. No. 7,832,343 to Walker and Bertram teaches a pyrolyzer with dual processing shafts and heat transfer fins to transfer heat to the heating chamber. However, both of these approaches are still inefficient at processing waste.

All publications identified herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

Another important design consideration for pyrolytic ovens is durability. Pyrolytic ovens generally must be able operate efficiently at sustained high temperatures. The expansion and contraction of metals from heating and cooling can greatly impact the durability of the oven. Increasing the durability of a pyrolitic oven can lower engineering, construction, and maintenance costs.

Thus, there is still a need for improving both the efficiency and durability of pyrolytic ovens while decreasing overall construction, operational, and maintenance costs.

SUMMARY OF THE INVENTION

One aspect of the present inventive subject matter is directed to a fuel management system of a pyrolytic oven. The fuel management system includes a fuel management engine and a pyrolytic oven. The pyrolytic oven has an elongated heating chamber that is divided into multiple zones along the elongated dimension.

In some embodiments, the zones of the heating chamber are distinct portions along the elongated dimension of the heating chamber. Preferably, the zones do not overlap with one another. However, in some embodiments, the portions of the zones may interconnect or overlap.

The pyrolytic oven also includes multiple independently controllable heat sources, which correspond to the different zones of the heating chamber. In some embodiments, at least one heat source corresponds to each zone to provide heat for the corresponding zone. Preferably, different heat sources correspond to different zones such that no heat source is responsible for providing heat to more than one zone. In some embodiments, a heat source can include a gas burner, electric burner, or any other commercially suitable heat source. In some embodiments, the heat sources are located beneath the heating chamber, although it is contemplated that the heat sources may be dispersed around the sides or top of the heating chamber.

In some embodiments, the fuel management engine is communicatively coupled to the heat sources and is programmed to independently control each heat source of the pyrolytic oven. The fuel management system accomplishes this by dynamically determining a power level for each heat source then controlling each heat source based on the determined power level. The determined power levels of each heat source may be different.

In preferred embodiments, the fuel management system also includes sensors which correspond to different zones of the heating chamber. The sensors can be disposed within or near their corresponding zones of the heating chamber for detecting and monitoring sensor data associated with the corresponding zones. The sensors for each zone can include at least one of a temperature sensor, a humidity sensor, a weight sensor, etc. The sensors are also communicatively coupled to the fuel management engine. In these embodiments, the fuel management engine is programmed to retrieve or obtain sensor data from the sensors that correspond to the different zones of the heating chamber and to dynamically determine a power level required for each heat source based on the obtained sensor data. Upon determining a power level required for each heat source, the fuel management engine is programmed to configure the heat source based on the determined power level. In some embodiments, the fuel management engine is programmed to configure the heat source by adjusting the power state of the heat source based on the determined power level.

In order to dynamically determine power levels for the heat sources, the fuel management engine of some embodiments is programmed to continuously and iteratively retrieve sensor data from the sensors corresponding to the different zones. Different embodiments of the fuel management engine provides different interval for retrieving/obtaining sensor data from the sensors (e.g., every second, every 5 seconds, every 10 seconds, every ½ of a second, every ⅕ of a second, etc.). Whenever new readings of the sensor data are retrieved/obtained, the fuel management engine is programmed to determine a new power level for each heat source, and to configure the heat source (e.g., adjusting the power state of the heat source) based on the newly determined power level.

As such, the fuel management engine is programmed to determine a first power level for a first zone of the heating chamber based on a reading of sensor data from the sensors corresponding to the first zone, and determine a second power level for a second zone of the heating chamber based on a reading of sensor data from the sensors corresponding to the second zone. Since the condition of the feedstock at different zones may vary, and the reading of sensor data from the sensors corresponding to different zones also may vary, the fuel management engine is programmed to determine a different power level for different zones and different heat sources.

Another aspect of the inventive subject matter is directed toward a method for treating waste materials in a pyrolytic oven. The pyrolytic oven has an elongated heating chamber that is divided into multiple zones along the elongated dimension. Additionally, the pyrolytic has multiple independently controllable heat sources corresponding with each zone.

In some embodiments, a method for treating waste materials includes the step of feeding a waste load through the heating chamber and dynamically adjusting the power level of the heat sources corresponding with each of the zones. Preferably, the method also includes the step of adjusting the power level of each heat source corresponding with each zone independently from the power levels of other heat sources.

It is further contemplated that in some embodiments the pyrolytic oven also includes a temperature sensor corresponding with each zone. In these embodiments the method includes the step of monitoring, by the temperature sensors, a temperature of each zone from the plurality of zones. Some embodiments include the step of dynamically determining a power level for each heat source by monitoring the temperature for each zone then adjusting the power level for each heat source based on the reading from the corresponding temperature sensor. In some embodiments, the method includes the step of monitoring a temperature of each zone via the temperature sensors at a frequency such as 1 Hz, 2 Hz, and 5 Hz.

In some embodiments, the method includes the step of determining a power level of one heat source based on a corresponding temperature sensor in a corresponding zone, then determining a power level of different heat source based on a corresponding temperature sensor in a different zone. In these embodiments, the step of determining a power level for a heat source is performed independently than the step of determining the power levels of other heat sources. In some embodiments, the power levels of each heat source are different. However, the power levels of each heat source may also be the same.

It is also contemplated that in some embodiments the method includes the step of feeding the waste load through the heating chamber continuously.

Another aspect of the inventive subject matter is directed to a burner assembly of a pyrolytic oven that is universal to different fuel types. The burner assembly includes a burner box. In some embodiments, the burner box is insulated. In some embodiments, the burner box is rectangular.

The burner box includes a venturi structure which resides within the burner box. In some embodiments, the burner assembly includes a gas line connected to a side wall the burner box and to the venturi structure. In some embodiments, the burner box also contains temperature sensors, igniters, and flow regulators. Additionally, in some embodiments the burner box contains more than one venturi structure, and additional venturi structures are coupled to the same gas line or to an additional gas line. In preferred embodiments, the gas line is configured to transport propane, methane, ethane, natural gas, liquefied petroleum gas (LPG), landfill gas (LFG, digester gas, sewer gas, swamp gas, or other commercially viable hydrocarbon-containing fuels or blends of fuels. In some embodiments, the gas line is coupled to an actuator, which can be programmed to adjust the flow rate of the fuel through the gas line.

In some embodiments, the venturi structure has end members, a central pin spanning between the end members, and side members also spanning between the end members. Preferably, the side members are L-shaped and have a length greater than the length of the end members. In some embodiments the central pin is hollow. However, the subcomponents of the venturi structure may have other shapes and dimensions.

Another aspect of the inventive subject matter provides for a support structure for supporting a pyrolytic oven with an elongated heating chamber with respect to a supporting platform. The support structure includes a wing structure.

In some contemplated embodiments, the elongated heating chamber is suspended with respect to a supporting platform by a gusset. In these embodiments, the gusset is connected to a wing structure which spans substantially along the length of the heating chamber. In some embodiments, the heating chamber, gussets, and wing structure are all made of different metallic alloys, however one or more may be made of the same alloy.

In some embodiments, the wing structure spans 70%, 80%, or 90% along the length of the heating chamber. Also, in most embodiments, the wing structure has a lip portion (or flange) that exerts against the heating chamber at a higher pressure as the wing structure is heated up. In particular, in some embodiments, the wing structure may not contact the heating chamber at room temperature (between 61 and 79° F.), but may contact the heating chamber at a higher temperature. In some embodiments the support structure includes an insulating material disposed between the wing structure and the heating chamber.

In some embodiments, the pyrolytic oven includes a plurality of heat sources disposed beneath the heating chamber.

A final aspect of the inventive subject matter is directed toward a heating chamber of a pyrolytic oven with an inner tongue and groove structure.

In some embodiments, the heating chamber has inner panels, each with tongue and groove structures along an edge. In these embodiments, the tongue of one inner panel is sized to fit within the groove of a corresponding inner panel to form an interlock. In some embodiments, the heating chamber has multiple inner panels with multiple tongue and groove interlocks. Additionally, it is contemplated that in some embodiments these interlocks occur along an inner ridge of the heating chamber. In some embodiments, the heating chamber has a general reverse (or upside-down) heart shape.

In some embodiments, a panel has both a tongue and groove immediately adjacent to one another along one edge. It is also contemplated that in some embodiments the thickness of a tongue on one inner panel is substantially identical to the thickness of a corresponding panel.

Various objects, features, aspects and advantages of the inventive subject matter will become more apparent from the following detailed description of preferred embodiments, along with the accompanying drawing figures in which like numerals represent like components.

BRIEF DESCRIPTION OF THE DRAWINGS

FIG. 11 is a top, left, perspective view of a burner assembly for a pyrolytic oven.

FIG. 12 is a top, left, perspective breakaway view of an alternate embodiment of a burner assembly for a pyrolytic oven.

DETAILED DESCRIPTION

Figure 1:
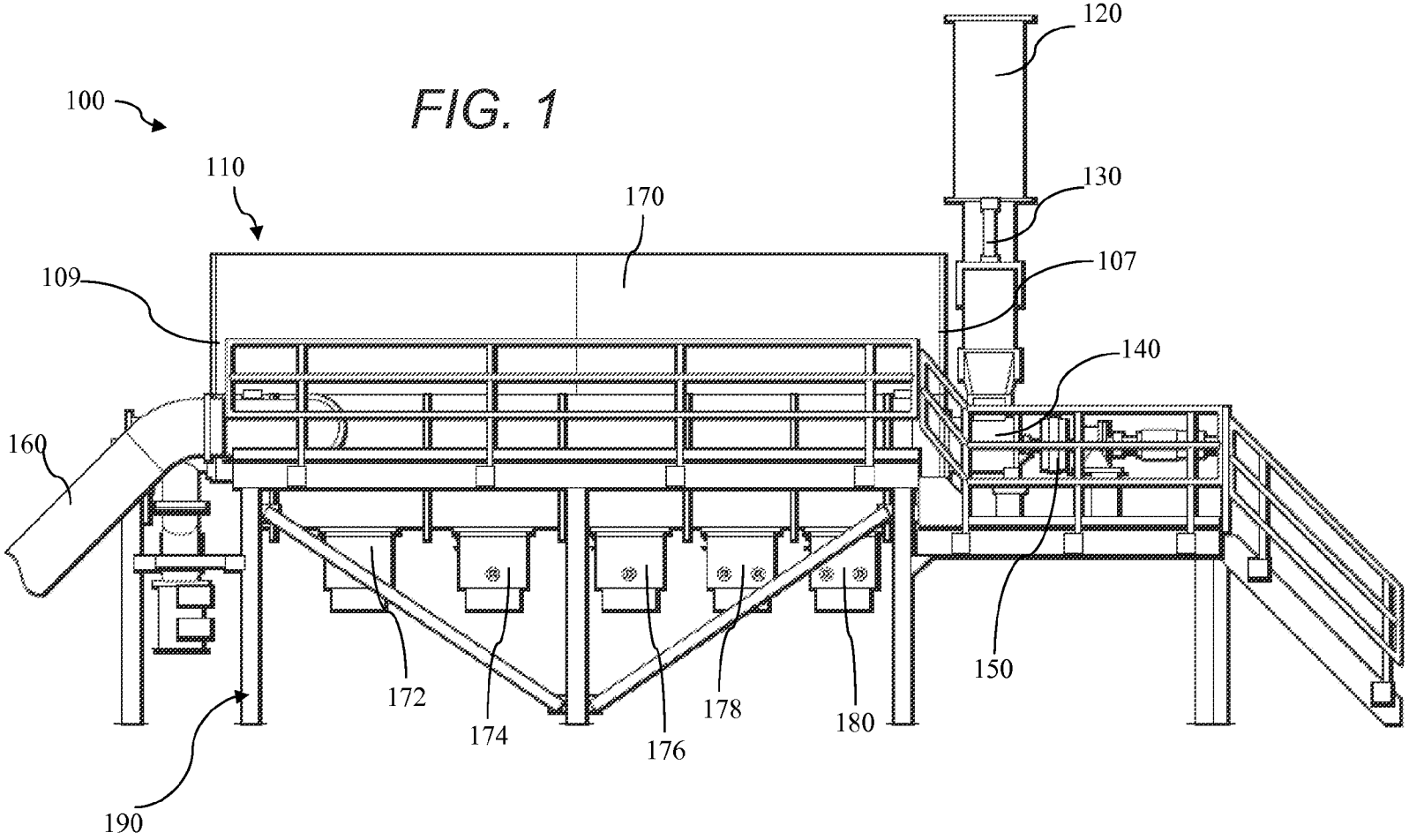
FIG. 1 is a left elevation view of a pyrolytic oven assembly.

Throughout the following discussion, numerous references will be made regarding servers, services, interfaces, engines, modules, clients, peers, portals, platforms, or other systems formed from computing devices. It should be appreciated that the use of such terms is deemed to represent one or more computing devices having at least one processor (e.g., ASIC, FPGA, DSP, x86, ARM, ColdFire, GPU, multi-core processors, etc.) configured to execute software instructions stored on a computer readable tangible, non-transitory medium (e.g., hard drive, solid state drive, RAM, flash, ROM, etc.). For example, a server can include one or more computers operating as a web server, database server, or other type of computer server in a manner to fulfill described roles, responsibilities, or functions. One should further appreciate the disclosed computer-based algorithms, processes, methods, or other types of instruction sets can be embodied as a computer program product comprising a non-transitory, tangible computer readable media storing the instructions that cause a processor to execute the disclosed steps. The various servers, systems, databases, or interfaces can exchange data using standardized protocols or algorithms, possibly based on HTTP, HTTPS, AES, public-private key exchanges, web service APIs, known financial transaction protocols, or other electronic information exchanging methods. Data exchanges can be conducted over a packet-switched network, a circuit-switched network, the Internet, LAN, WAN, VPN, or other type of network.

The terms "configured to" and "programmed to" in the context of a processor refer to being programmed by a set of software instructions to perform a function or set of functions.

The following discussion provides many example embodiments. Although each embodiment represents a single combination of components, this disclosure contemplates combinations of the disclosed components. Thus, for example, if one embodiment comprises components A, B, and C, and a second embodiment comprises components B and D, then the other remaining combinations of A, B, C, or D are included in this disclosure, even if not explicitly disclosed.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

In some embodiments, numerical parameters expressing quantities are used. It is to be understood that such numerical parameters may not be exact, and are instead to be understood as being modified in some instances by the term "about." Accordingly, in some embodiments, a numerical parameter is an approximation that can vary depending upon the desired properties sought to be obtained by a particular embodiment.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

Unless the context dictates the contrary, ranges set forth herein should be interpreted as being inclusive of their endpoints and open-ended ranges should be interpreted to include only commercially practical values. The recitation of ranges of values herein is merely intended to serve as a shorthand method of referring individually to each separate value falling within the range. Unless otherwise indicated herein, each individual value within a range is incorporated into the specification as if it were individually recited herein. Similarly, all lists of values should be considered as inclusive of intermediate values unless the context indicates the contrary.

Methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the described concepts and does not pose a limitation on the scope of the disclosure. No language in the specification should be construed as indicating any non-claimed essential component.

Groupings of alternative elements or embodiments of the inventive subject matter disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

Overview

Pyrolysis is a process of decomposing materials by applying high temperatures to the materials in a pyrolytic oven, often in the absence of oxygen or halogen. The decomposable materials are often referred to as feedstocks. While pyrolysis is usually associated with the processing of waste materials (e.g., trash, tires, and other municipal, industrial, agricultural, or domestic wastes), a feedstock can also include any organic or inorganic materials, such as food, charcoal, biochar, coke, carbon fiber, pyrolytic carbon, plastic waste, biofuel, or any other substance in a commercially viable application that is meant to undergo pyrolysis. The pyrolytic oven is an apparatus in which a feedstock is decomposed through pyrolysis. The term "pyrolytic oven" is synonymous with "pyrolytic converter," "thermal oxidation system," "thermal converter", "pyrolyzer," or "pyrolytic reactor."

FIG. 1 illustrates an example pyrolytic oven assembly 100. In some embodiments, pyrolytic oven assembly 100 has a pyrolytic oven 110 and supporting structure 190. Pyrolytic oven 110 is coupled to and is substantially supported by supporting structure 190. As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously. "Substantially supported" means at least 50% of the weight of pyrolytic oven 110 is supported by supporting structure 190.

Pyrolytic oven 110 has a feedstock input 120, front airlocks 130, dual conveyors 140, conveyor motors 150, syngas output 160, heating chamber assembly 170, and heat sources 172-180. In some embodiments, feedstock input 120 is configured to receive feedstock and pass the feedstock into pyrolytic oven 110. Different embodiments of the feedstock input 120 can comprise different structures. For example, feedstock input 120 can include at least one of the following structures: a chute, pipe, shaft, funnel, slide, conduit, or other structure for conveying a feedstock. In some embodiments, feedstock input 120 further comprises front airlocks 130. Front airlocks 130 are configured to prevent oxygen from entering into the system. Examples of front airlocks 130 include rotary airlocks, knife valves, and any other commercially suitable airlock. Feedstock input 120 is coupled to the front end 107 of heating chamber assembly 170, such that the feedstock will be passed into the heating chamber (not shown) of the heating chamber assembly 170 via dual conveyors 140. As used herein, "heating chamber" refers to an inner chamber or vessel where materials are heated, distilled, decomposed, or processed by the application of heat. The heating chamber may alternatively refer to a retort or a retort oven or any other commercially similar structure where materials can be processed, heated, distilled, decomposed, or processed by the application of heat.

Dual conveyors 140 are also configured to push the feedstock through heating chamber assembly 170 of the pyrolytic oven 110. Dual conveyors 140 can be screw augers, screw conveyors, conveyor belts, or any other commercially equivalent mechanism for transporting solid and liquid material. Although pyrolytic oven 110 is shown to have a dual conveyor in FIG. 1, it is contemplated that pyrolytic ovens of some embodiments can be equipped with a single conveyor or with more than two conveyors. Additionally, both continuous-feed and non-continuous feed systems are also contemplated. Continuous-feed systems can use augers, conveyor belts, or similar means to transport a feedstock continuously through the oven. Non-continuous systems require the feedstock to be placed in oven prior to processing, then removed after processing before additional feedstock can be processed.

In some embodiments, processing the feedstock in pyrolytic oven 110 results in at least syngas and char. Syngas refers to the gaseous byproduct of a pyrolytic reaction. The syngas can comprise a fuel gas mixture consisting of hydrogen, carbon monoxide, and carbon dioxide. Additionally, or alternatively, the syngas can comprise other elements or components. Syngas can be used as an intermediate in creating synthetic natural gas, ammonia, methanol, synthetic petroleum, or similar products and their derivatives. Char means a solid, liquid, or semi-solid byproduct of a pyrolytic reaction and can include charcoal, biochar, etc. Other contemplated byproducts of the pyrolytic reaction in pyrolytic oven 110 include steam, energy, biochar, or biofuels. In some embodiments, pyrolytic oven 110 includes syngas output 160 that is coupled to heating chamber assembly 170. Syngas output 160 is configured to allow syngas produced during decomposition of feedstock within heating chamber assembly 170 to exit pyrolytic oven 110. Preferably, syngas output 160 is coupled to the heating chamber assembly 170 at a location near the back end 109 of the heating chamber assembly 170, as the majority of the syngas is being produced during the later stage of the decomposition. Syngas output 160 can be a chute, pipe, shaft, funnel, slide, or conduit, etc.

Heat sources 172-180 are configured to provide heat to the heating chamber, for decomposing the feedstock. Each one of the heat sources 172-180 can include one or more gas burners, electric burners, jet burners, heat exchangers, steam heat sources, coal burners, and/or liquid fuel burners, etc. Besides gas burners, various methods are contemplated to provide heat to the feedstock—including electric heating elements (e.g. electric burners), partial combustion through air injection, direct heat transfer from a hot gas, indirect heat transfer with exchange surfaces (such as the wall of heating chamber assembly 170 or tubes), and direct heat transfer from circulating solids, or other commercially viable means for heating. In this example, heat sources 172-180 are located beneath heating chamber assembly 170 to provide indirect heat to the feedstock via the wall (enclosure) of the heat chamber. However, heat sources 172-180 can alternatively be located on the side or on the top of the pyrolytic oven 110.

In some embodiments, pyrolytic oven 110 operates independently to decompose feedstock and produce syngas, while in other embodiments, pyrolytic oven is part of a larger waste processing train, and integrated with other standard equipments to generate energy, steam, biochar, or biofuels, etc.

Figure 2:
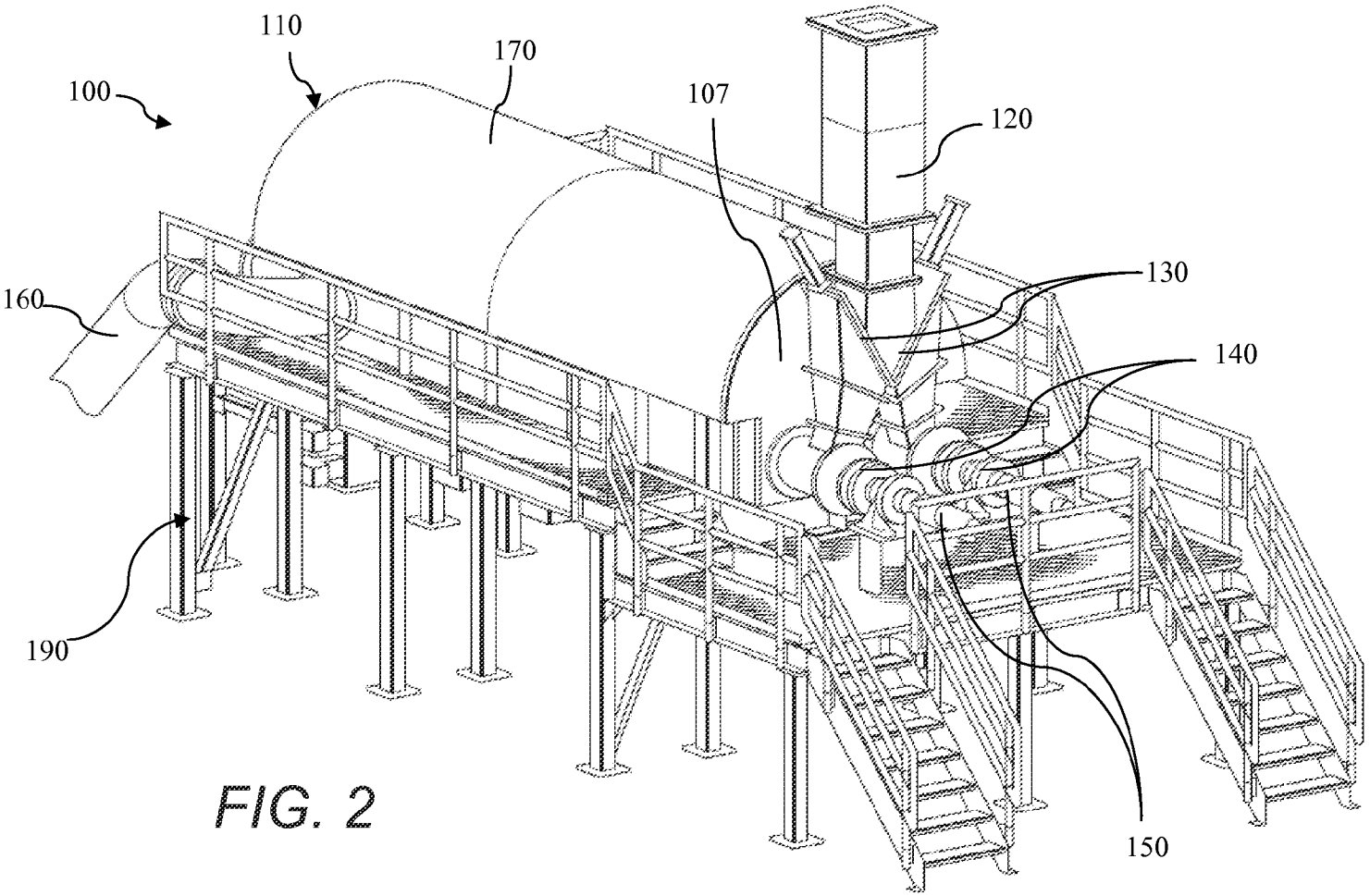
FIG. 2 is a top, left, perspective view of a pyrolytic oven assembly.
Figure 3:
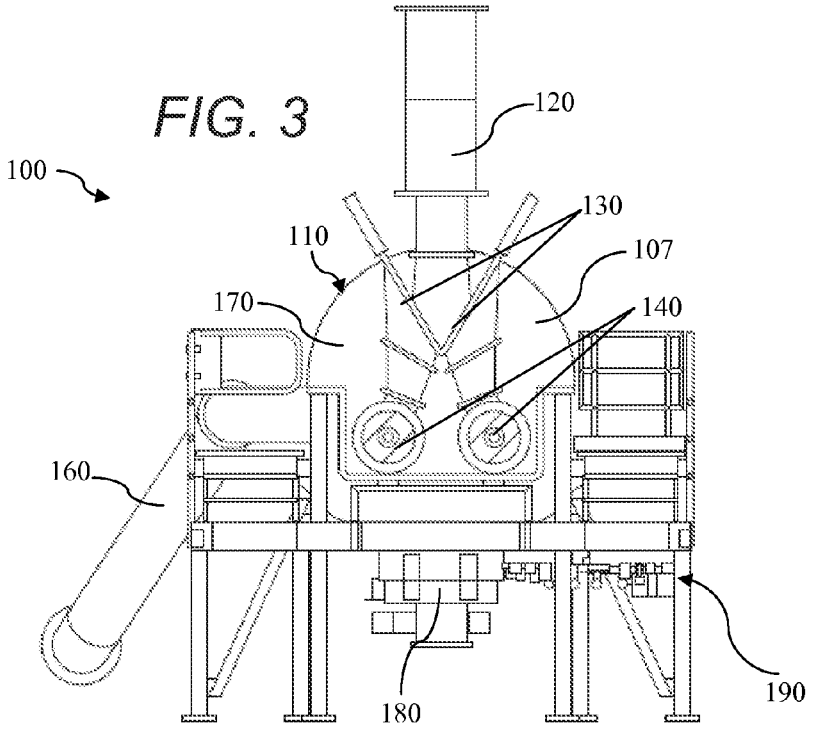
FIG. 3 is a front end view of a pyrolytic oven assembly.

FIG. 2 illustrates pyrolytic oven assembly 100 from a top, right perspective view. As shown from this view, dual conveyors 140 of pyrolytic oven 110 also include conveyor motors 150 for driving the dual conveyors 140. FIG. 3 illustrates pyrolytic oven assembly 100 from a front end view.

Figure 4:
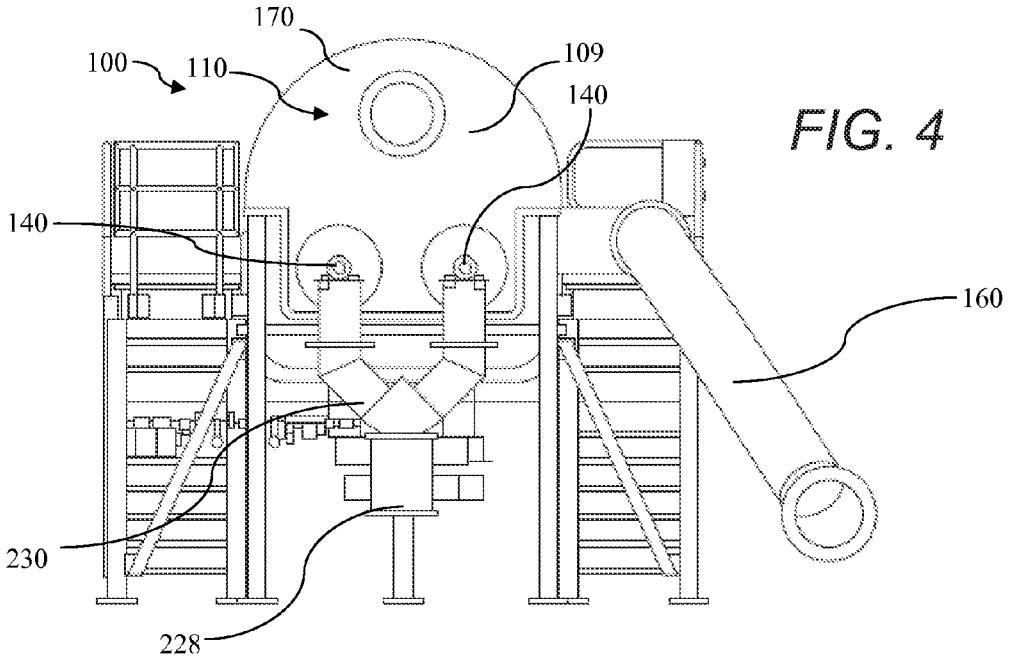
FIG. 4 is a back end view of a pyrolytic oven assembly.
Figure 5:
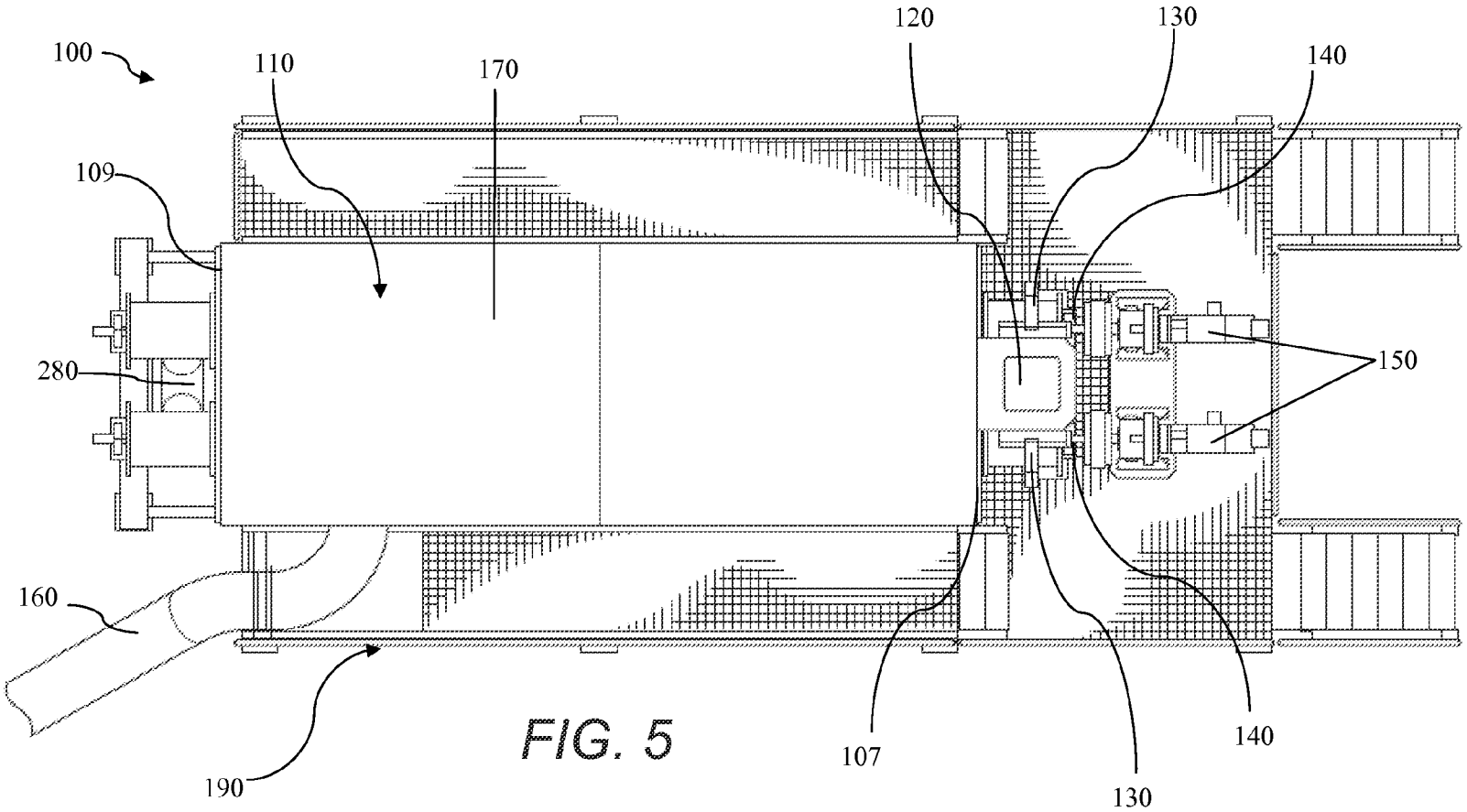
FIG. 5 is a top plan view of a pyrolytic oven assembly.

FIG. 4 illustrates pyrolytic oven assembly 100 from a back end perspective view. In addition to the elements shown by reference to FIGS. 1-3 above, the back end perspective view shows that pyrolytic oven assembly 100 also includes char output 280. Similar to syngas output 160, char output 280 is coupled to heating chamber assembly 170. Char output 280 is configured to allow char produced during decomposition of feedstock within heating chamber assembly 170 to exit pyrolytic oven 110. Preferably, char output 280 is coupled to the heating chamber assembly 170 at a location near the back end 109 of the heating chamber assembly 170, as the majority of the char is produced during the later stage of the decomposition. Char output 280 can be a chute, pipe, shaft, funnel, slide, or conduit, etc. for transporting char out of pyrolytic oven 110. Char output 280 further comprises rear airlocks 230, which prevent oxygen from entering the system and can be rotary airlocks, knife valves, or any other commercially suitable airlock. In some contemplated embodiments, char output 280 may further comprise a carbon discharge conveyor with a screw auger (not shown) for removing char from pyrolytic oven 110. FIG. 5 illustrates pyrolytic oven assembly 100 from a top perspective view.

Independently Controllable Heat Sources

It is contemplated that a feedstock can vary in composition which may affect its decomposition characteristics. Additionally, different compositions of feedstock may require application of different amounts of heat for optimal decomposition to occur. Thus, in one aspect of the inventive subject matter, an energy-efficient pyrolytic system is provided. In some embodiments, the pyrolytic system includes a pyrolytic oven having a heating chamber divided into multiple zones along an elongated dimension of the heating chamber. The pyrolytic system also includes multiple independently controllable heat sources. In some embodiments, each independently controllable heat source corresponds to a zone of the heating chamber, and configured to provide heat for feedstock within the zone. The multiple independently controllable heat sources are communicatively coupled to a fuel management system that is programmed to configure the heat sources. By configuring the independently controllable heat sources, the fuel management system can provide different amounts of heat to different zones depending on the condition of the feedstock within the zones. Thus, it is also contemplated that the pyrolytic system includes sensors that are placed within or near the different zones of the heating chamber to detect and monitor the condition of the feedstock. The sensors are communicatively coupled to the fuel management system to provide real-time information of the feedstock to the fuel management system. The fuel management system is then programmed to configure the heat sources based on the real-time information.

Figure 6:
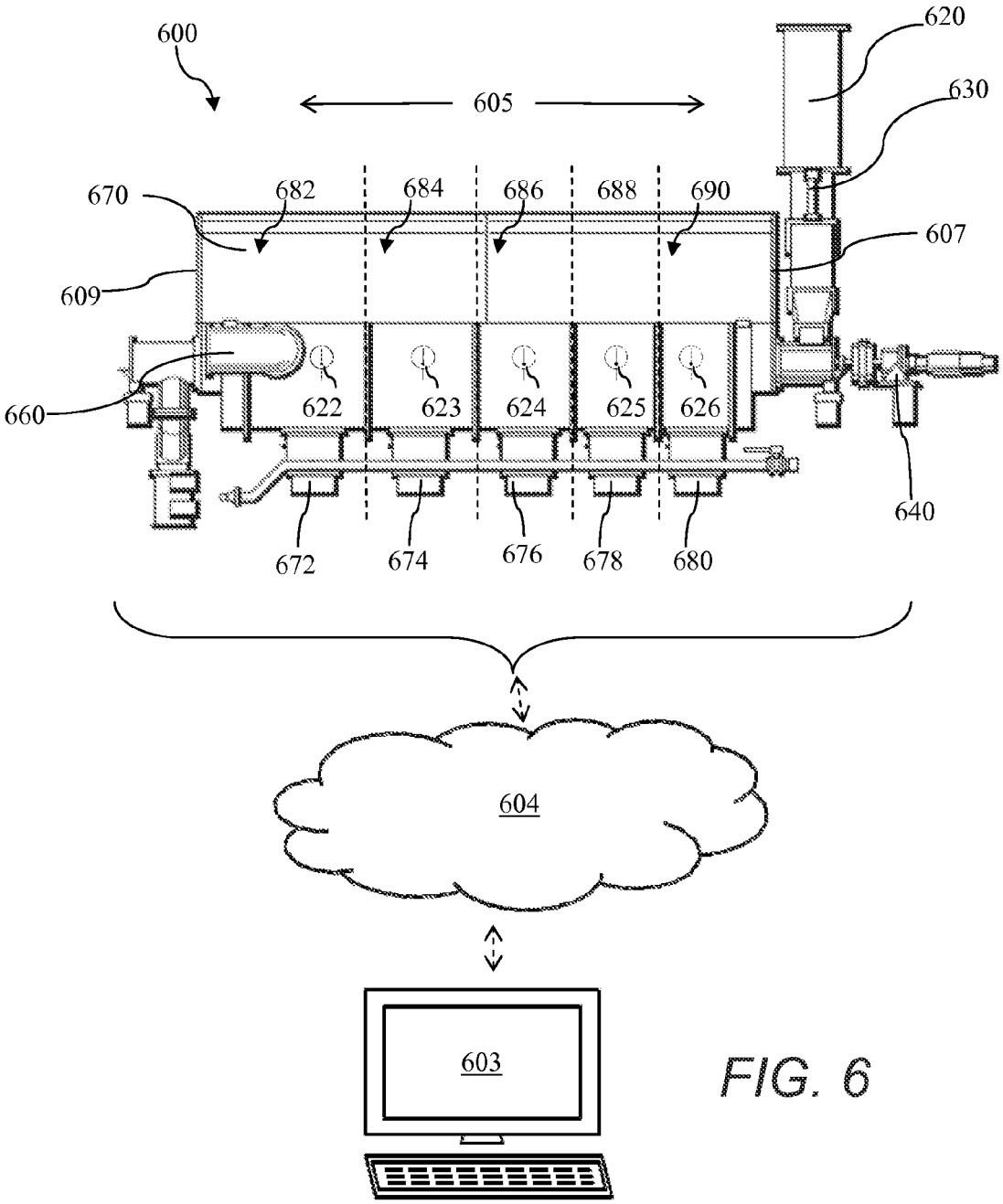
FIG. 6 is a pyrolytic system with a pyrolytic oven having multiple zones and multiple heating sources connected to a fuel management system.

FIG. 6 illustrates an example of such a pyrolytic system 600. The pyrolytic system 600 includes a pyrolytic oven 610 that is similar to pyrolytic oven 110 of FIGS. 1-5, and a fuel management system 603 represented by one or more computing devices in this example. As shown, the pyrolytic oven 610 includes a heating chamber 670, heat sources 672-680, zone sensors 622-626, feedstock input 620, front airlocks 630, dual conveyors 640, and syngas output 660.

As shown, the heating chamber 670 has an elongated dimension 605 that extends from the front end 607 of the heating chamber assembly to the back end 609 of the heating chamber assembly. In some embodiments, heating chamber 670 is divided into multiple zones 682-690 along its elongated dimension 605. Preferably, the multiple zones 682-690 are non-overlapping. In some embodiments, the multiple zones are not separated by any barriers within the heating chamber; they only represent a different spatial section within the chamber along the elongated dimension 605, however zones which are physically separated by a barrier are also contemplated. Additionally, the zones may be interconnected or may overlap.

As shown, at least one heat source from the multiple heat sources 672-680 and at least one sensor from the multiple zone sensors 622-626 correspond to each of the multiple zones 682-690. For example, heat source 672 and zone sensor 622 correspond to zone 682, heat source 674 and zone sensor 623 correspond to zone 684, heat source 676 and zone sensor 624 correspond to zone 686, heat source 678 and zone sensor 625 correspond to zone 688, and heat source 680 and zone sensor 626 correspond to zone 690. Each heat source 672-680 is configured to provide indirect heat to the feedstock when the feedstock is located within its corresponding zone as the feedstock passes through the heating chamber 670.

It is contemplated that zone sensors 622-626 can be located anywhere within the heating chamber 670. For example, the sensors 622-626 can be disposed inside the heating chamber 670, on the exterior enclosure of the heating chamber 670, on the interior wall of the heating chamber 670, etc. Additionally, each zone sensor can include one or more types of sensor unit for detecting a property of the zone or the feedstock, including but not limited to, a temperature sensor, a humidity sensor, a scale (weight sensor), a camera, a spectroscopic sensor, a spectral scanner, a particle detector, a flame scanner, and a gas detector. For example the first zone can comprise a first set of sensors configured to monitor a temperature and a composition of the feedstock in the first zone, and the second zone can comprise a second set of sensors configured to monitor a temperature and a composition of the feedstock in the second zone.

In this example, heat sources 672-680 are disposed immediately beneath the heating chamber 670, but other locations for the heat sources are possible. It is further contemplated that the heat sources 672-680 can comprise at least a gas burner, an electric burner, or any other commercially viable heat source. As mentioned above, heat sources 672-680 are independently controllable. That is, different settings (e.g., heat power, burner height, flow rate) of each heat source 672-680 can be configured (e.g., adjusted) independently from the other heat sources 672-680 within the pyrolytic system 600.

As shown, heat sources 672-680 and zone sensors 622-626 are communicatively coupled to fuel management system 603. In some embodiments, heat sources 672-680 and zone sensors 622-626 are communicatively coupled to fuel management system 603 locally via a cable (e.g., Ethernet cable, USB cable, Firewire® cable, etc.). In some other embodiments, heat sources 672-680 and zone sensors 622-626 are communicatively coupled to fuel management system 603 wirelessly via a short range wireless protocol (e.g., WiFi, Bluetooth®, etc.). In yet some other embodiments, the fuel management system 603 is distal from the pyrolytic oven 610, and is communicatively coupled to heat sources 672-680 and zone sensors 622-626 over a network (e.g., local area network, wide area network, wireless network, the Internet, etc.). In these embodiments, the pyrolytic oven 610 also includes a network interface 604 to facilitate communication between heat sources 672-680, zone sensors 622-626, and the fuel management system 603.

In some embodiments, the fuel management system 603 includes one or more computing devices. The computing devices has at least one processor and memory that stores software instructions, which when executed by the at least one processor, programs the at least one processor to perform functions and features associated with the fuel management system 603. The fuel management system 603 of some embodiments is programmed to obtain or retrieve real-time (or substantially real-time) sensor data from the zone sensors 622-626. As used herein, the term "real-time" is defined as within 0.1 seconds. Sensor data that is obtained from zone sensors 622-626 include at least one of the following: temperature data, humidity data, weight data, image data, etc.

Upon retrieving the sensor data from zone sensors 622-626, fuel management system 603 is programmed to analyze the sensor data to determine characteristics of the feedstock located in each of the multiple zones 682-690. In some embodiments, the fuel management system 603 is programmed to generate a feedstock profile for each of the multiple zones 672-680. Based on the feedstock profile of a zone, the fuel management system 603 is programmed to configure the heat source corresponding to that zone to optimize the decomposition of feedstock located within the zone.

Figure 7:
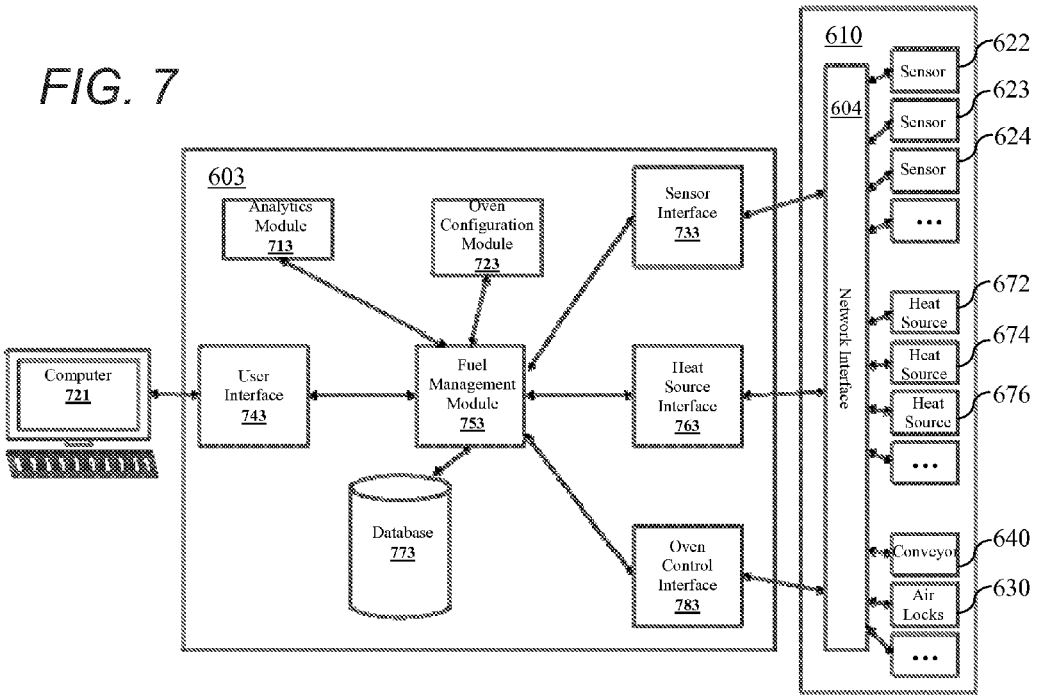
FIG. 7 is a schematic showing a fuel management system for a pyrolytic oven.

FIG. 7 illustrates an example fuel management system 603 of the embodiment in FIG. 6. The fuel management system 603 is connected to a user computer 721, and a pyrolytic oven 610. Fuel management system 603 includes a fuel management module 753, user interface 743, analytics module 713, oven configuration module 723, sensor interface 733, heat source interface 763, database 773, and an oven control interface 783. The fuel management system 603 includes at least one processing unit (e.g., a processor, a processing core, etc.). In some embodiments, fuel management module 753, user interface 743, analytics module 713, oven configuration module 723, sensor interface 733, heat source interface 763, and oven control interface 783 are implemented as software modules that include software instructions, that when executed by the at least one processing unit, cause the at least one processing unit to perform functions and features described herein.

Pyrolytic oven 610 includes zone sensors (e.g., zone sensors 622-626), heat sources (e.g., heat sources 672-680), conveyor 640, and a network interface 604 for facilitating communication between the zone sensors, the heat sources, the conveyor, and the fuel management system 603.

As mentioned above, the heat sources and sensors correspond to different zones of the heating chamber, such that each zone has at least one corresponding and distinctive sensor and heat source. Each of the sensors and heat sources has an interface (e.g., application programming interface (API), etc.) that allows other computing devices or systems to access them. For example, the fuel management system 603 can actively retrieve sensor data from the sensors via the sensors' APIs and configure the settings (e.g., power level state) of the heat source via the heat sources' APIs.

Database 773 comprises one or more non-transitory electronic storage medium (e.g., hard drive, flash drive, etc.) that stores different types of information for the fuel management system 603. For example, database 773 may store information related to the sensors, the heat sources, and the different zones of the pyrolytic oven 610. The information related can be a priori information or can be extracted by the fuel management system 603 by communication with the sensors 622-626 and heat sources 672-680. The information can include a relative location of each zone (i.e., the location of the zone relative to the other zones), and a size of each zone. The information can also include a mapping of each zone to its corresponding sensors and heat sources. Furthermore, the information can also include attributes of the sensors (e.g., sensor type, type of sensor data, measurement unit, etc.) and attributes of the heat sources (e.g., the different adjustable power levels such as low, medium, high, etc.).

In some embodiments, fuel management module 753 of the fuel management system 603 is programmed to actively retrieve sensor data from sensors 622-626 via the sensor interface 733. As mentioned above, the retrieved sensor can include at least one of the following: temperature data, humidity data, weight data, etc. In some embodiments, fuel management module 753 is programmed to retrieve the sensor data from sensors 622-626 on a periodic basis (e.g., every second, every 5 seconds, every 10 seconds, every ½ second, every ⅕ second). Fuel management module 753 is then programmed to pass the sensor data to analytics module 713. Analytics module 713 is programmed to retrieve the information related to the sensors 622-626, the heat sources 672-680, and the zones from the database 773 and then analyze the sensor data in view of the retrieved information. Based on the analysis, analytics module 713 of some embodiments is programmed to generate a feedstock profile for each zone. The feedstock profile of each zone can include information such as a weight of the feedstock, a temperature of the feedstock, an ambient temperature of the zone, a humidity of the zone, composition of the feed stock, etc. Analytics module 713 is then programmed to determine a required heat level for each zone according to a set of rules, and generate instructions to configure the settings for the heat sources 672-680. In some embodiments, configure the settings for a heat source include adjusting a power level state (e.g., from high to medium, from low to medium, etc.)

of a heat source. Based on the sensor data, fuel management system 603 may configure different settings for the heat sensors of different zones, based on the feedstock profiles of the zones.

In addition to configuring the heat sources 672-680, fuel management system 603 of some embodiments is also programmed to configure conveyor 640, air locks 630, and any other elements of the pyrolytic oven 610 that are communicatively coupled to fuel management system 603 based on the feedstock profiles of the zones. Similar to the process above, fuel management system 603 is programmed to generate instructions to configure conveyor 640 and air locks 630 based on the feedstock profiles of the different zones. For example, fuel management system 603 can configure conveyor 640 to slow down when temperature data of the different zones show that the feedstock is not hot enough, and thus, not effectively decomposed within the heating chamber. On the other hand, fuel management system 603 can configure conveyor 640 to speed up when temperature data of the different zones show that the feedstock is too hot, and thus, wasting heat and energy as the feedstock is completely decomposed prior to reaching the back end of the heating chamber of pyrolytic oven 610.

As shown, fuel management system 603 is also communicatively coupled to a user computer 721. In some embodiments, fuel management module 753 provides a user interface (e.g., a graphical user interface (GUI)) that enables an administrator of the pyrolytic system to monitor progress of the pyrolytic process within pyrolytic oven 610, and to modify the rules that govern the manner in which analytics module generate instructions based on the retrieved sensor data. In some embodiments, the fuel management system allows the user to configure the settings via the user interface.

In some embodiments, fuel management system 603 is programmed to save and store a log of the sensor data and instructions to the heat sources 672-680, conveyor 640, and air locks 630 in database 773. Once analytics module 713 has generated instructions to configure heat sources 672-680, fuel management module 753 is programmed to send to each of the heat sources 672-680 via the heat source interface 763 the respective configuration instructions. The heat sources 672-680 automatically adjust their settings upon receiving the instructions from the fuel management system 603. As mentioned above, fuel management system 603 is programmed to dynamically adjust the settings of heat sources 672-680 to maximize the energy efficiency of the pyrolytic oven 610. As such, fuel management system 603 continues to periodically retrieve sensor data from sensors 622-626, generate feedstock profiles for the zones based on the latest sensor data, and configure heat sources 672-680 according to the generated feedstock profiles for the zones. This way, the heat sources are always providing the optimal amount of heat for the decomposition process of the feedstock within the chamber, depending on the condition of the feedstock in each zone.

In one example, fuel management system 603 is programmed to maintain a constant temperature across the different zones. If fuel management system 603 detects that the temperature of one zone decreases with respect to the temperature of other zones, fuel management system 603 is programmed to increase the power level of the heat source(s) corresponding to that zone, thereby increasing the temperature of the zone.

In another example, fuel management system 603 is programmed to maintain a certain temperature for each individual zone. The temperature assigned to each zone can be determined before the pyrolytic operation begins, and can be adjusted during the operation. In addition, the temperatures that fuel management system 603 is programmed to maintain for the different zones can be different from one another. In this example, fuel management system 603 is programmed to continuously and periodically retrieve temperature readings from the temperature sensors corresponding to the different zones. When the retrieved temperature data of one zone indicates that it has a higher temperature reading than the required temperature setting, fuel management system 603 is programmed to reduce the power level of the heat source(s) corresponding to that zone. Similarly, when the retrieved temperature data of one zone indicates that it has a lower temperature reading than the required temperature setting, fuel management system 603 is programmed to increase the power level of the heat source(s) corresponding to that zone.

In another example, fuel management engine is programmed to maintain the temperature of the zone 690 (the zone closest to the front end 607) of the pyrolytic oven 610 to be 10, 20, or 50 degrees Fahrenheit hotter than the temperature of the other zones. Accordingly, fuel management system 603 is programmed to retrieve temperature data from the feedstock profile of zone 690 and compare the temperature of zone 690 with the temperature data of the other zones. When the retrieved temperature data of zone 690 has a higher or lower temperature reading than the other zones, fuel management system 603 is programmed to increase or decrease the power level of the heat source(s) corresponding with zone 690.

Figure 8:
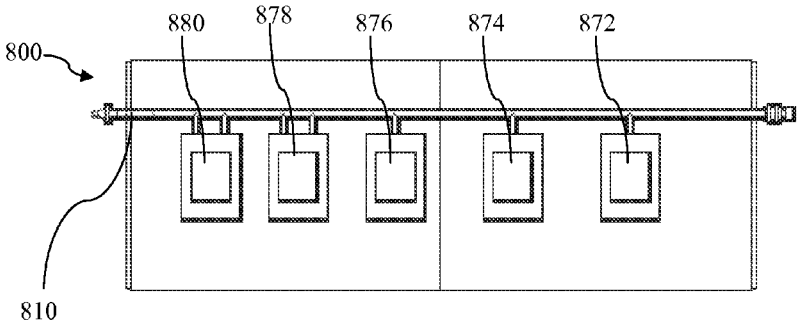
FIG. 8 a bottom plan view of a pyrolytic oven with multiple zones and multiple heating sources.

FIG. 8 shows a cutaway right elevation view of a fuel management system for a thermal converter with multiple heat sources. In FIG. 8, fuel management system 800 has a central gas line 810 and heating sources 872-880, which can be connected to a supporting structure.

Prior pyrolytic ovens teach the use of burners located at the front of the oven. These ovens often use fans or other means to circulate heat around the top, sides, and bottom of the heating chamber, with the idea to make the heat applied to the entire oven as uniform as possible. In contrast, in preferred embodiments, heat sources 872-880 are located along the elongated dimension below the heating chamber, such that the heat produced by the plurality of heat sources is concentrated along the bottom of the heating chamber, such that the distance between the feedstock and the heat sources is minimized. This allows heat to be focused on where it is most needed for pyrolysis. Additionally, this means that temperatures in each zone along the elongated dimension may vary as needed.

Figure 9:
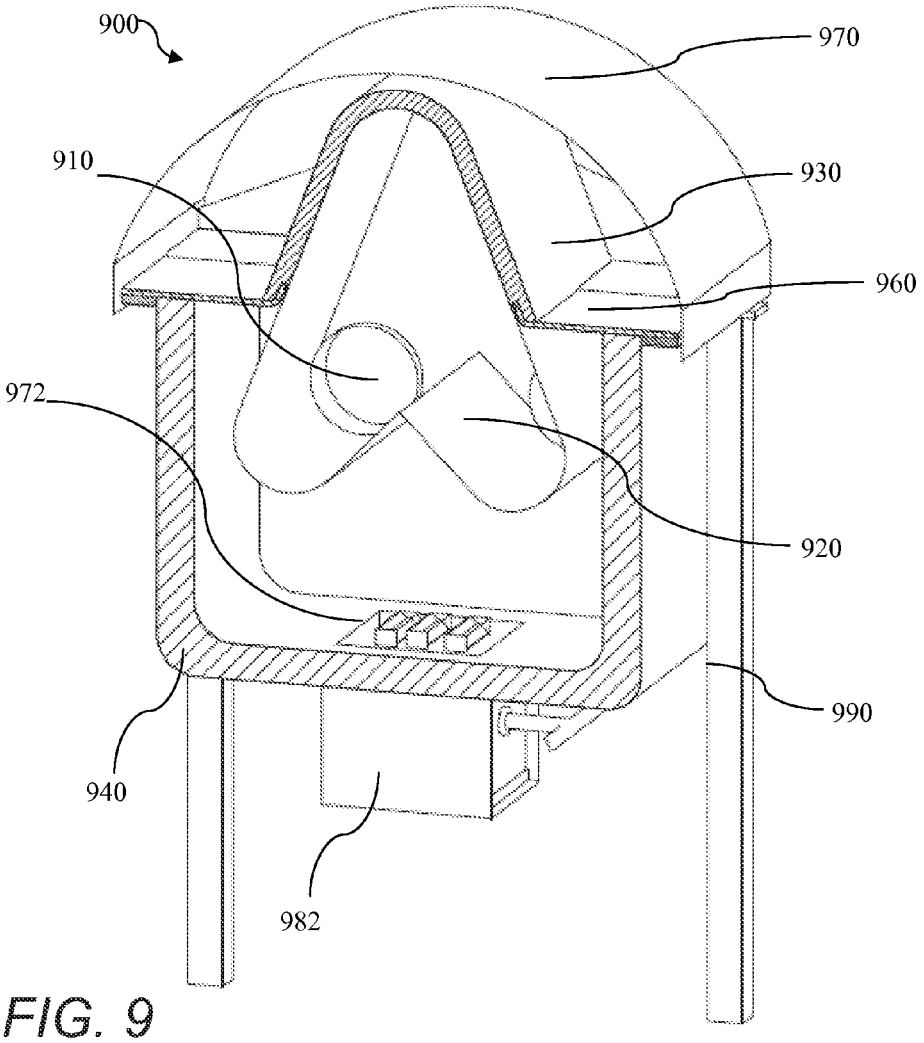
FIG. 9 is a cutaway perspective view of a pyrolytic oven with a heating chamber and multiple zones and multiple heating sources.

FIG. 9 illustrates a cross section of a pyrolytic oven 900 with multiple zones and configured to receive multiple heating sources. In FIG. 9, pyrolytic oven 900, has lid 970, tray 940, conveyor holes 910, heating chamber 920, insulator 930, wing 960, heat source hole 972, heat source 982, and post 990. It is contemplated that sensors can be located anywhere in the space between tray 940 and heating chamber 920, including on the surface of the heating chamber 920 or inside of heating chamber 920. In some embodiments, the plurality of heat sources 982 and heating sensors can be disposed below the heating chamber, but other locations for both the heat sources and the heating sensors are possible. It is further contemplated that the plurality of heat sources can comprise at least a gas burner, an electric burner, or any other commercially viable heat source.

Figure 10:
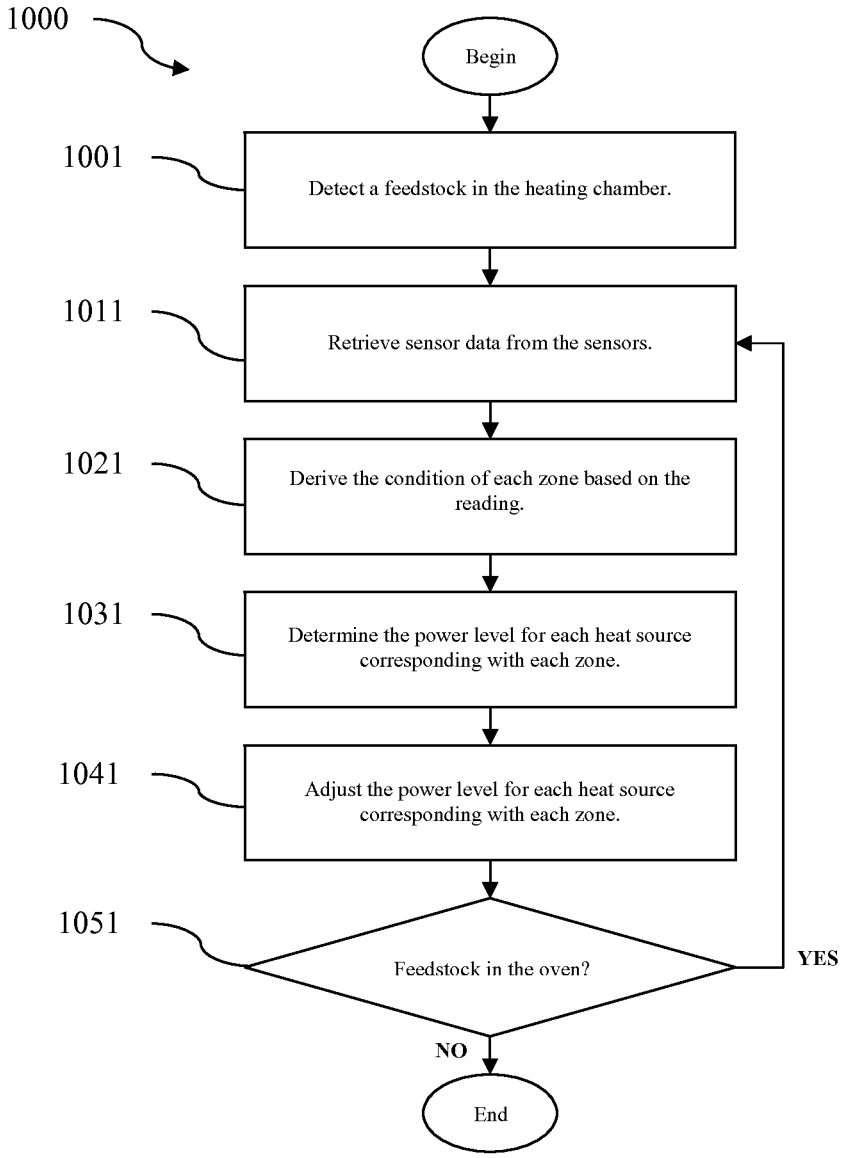
FIG. 10 is a workflow diagram showing a method for heating a pyrolytic oven.

FIG. 10 illustrates a process 1000 for treating waste materials in a pyrolytic oven or elongated heating chamber with a plurality of zones with independently controlled heat sources. The process includes (a) feeding a waste load or feedstock through the heating chamber; and (b) dynamically adjusting a power level of a first heat source corresponding to a first zone independent of the remaining heat sources.

In some embodiments, the method is preferably performed by a fuel management system. In FIG. 10, process 1000 begins with the fuel management system actively detecting (at step 1001) a feedstock in the heating chamber. After detecting the feedstock, the fuel management system actively retrieves (at step 1011) sensor data of multiple sensors corresponding to the different zones. Next, the fuel management system determines the feedstock profile by deriving the condition of each zone based on the reading from the sensors (step 1021). After generating the feedstock profile, the fuel management system determines the power level for each heat source corresponding with each zone (step 1031). After the power level for each zone has been determined, the fuel management system adjusts the power level for each heat source corresponding with each zone (step 1041). The fuel management system checks to see if the feedstock is still in the oven (step 1051). If the feedstock is still in the heating chamber, then the fuel management system can run steps 1011-1051 again. If the feedstock is no longer in the heating chamber, the fuel management system can stop monitoring and adjusting the temperature of the oven.

In preferred embodiments, the method can further comprises continuously feeding the waste load through the heating chamber via screw augers or a conveyor. In these embodiments, the method would be performed continuously as long as a feedstock is detected in the heating chamber. It is contemplated that some pyrolytic ovens will not be configured to continuously process a feed stock. In these embodiments, the method additionally comprises the step of feeding a feedstock into the heating chamber and removing the feedstock from the heating chamber.

The benefits of having such an independently controllable heating system for the oven include achieving optimal efficiency regardless of the type of feedstock, an amount of feedstock, and a flow rate of the feedstock.

Burner Assembly System

It is contemplated that different fuel types (e.g. propane, natural gas, syngas, methane, ethanol) have different properties such as density, gas pressure, etc. As a result, many prior art pyrolytic ovens require a retrofit in order to utilize different fuel types. Thus, one aspect of the inventive subject matter provides for a burner assembly system that is dynamically universal to different gas fuel types without requiring a retrofit. In some embodiments, the burner assembly system includes a burner box containing at least one venturi burner structure coupled to a gas line. In some embodiments, the gas line is coupled to a flow regulator, and the burner assembly system also includes a temperature sensor. The flow regulator and the temperature system are communicatively coupled to the burner assembly system, which is programmed to adjust the flow rate of fuel via the flow regulator based on feedback from the temperature sensor. By configuring the flow rate of fuel via the flow regulator, the burner assembly system can dynamically adjust to different fuel types.

FIG. 11 illustrates an example of such a burner assembly 1100. As shown, burner assembly 1100 includes a burner box 1110, a flange 1115, a refractory 1120, an igniter 1130, gas lines 1140, venturi burner structure 1150, supporting member 1160, and flow regulator 1170. In some embodiments, burner assembly 1100 is communicatively coupled to a burner assembly system, which may include one or more computing devices. In these embodiments, burner assembly 1100 and its components can be configured to be monitored and controlled by the burner assembly system.

As shown in FIG. 11, burner box 1110 has gas lines 1140, which extend through a side wall of burner box 1110 and couple with venturi structure 1150. In some embodiments, gas lines 1140 are configured to transport more than one type of fuel such as propane, natural gas, syngas, methane, ethane, ethanol, liquefied petroleum gas (LPG), landfill gas (LFG), digester gas, sewer gas, biogas, blended gases, or other commercially viable hydrocarbon-based fuel sources. Preferred fuels contain hydrocarbon chains with five or less carbon atoms. In some embodiments, gas lines are configured to supply fuel to a "renewable" fuel burning pyrolytic oven. In these embodiments, gas lines supply the pyrolytic oven with a fuel mixture with 50%, 25%, 10%, or 0% fossil fuels. In some embodiments, burner assembly is capable of an output of 0.25, 0.5, 1, and 2 million BTU and provides for indirect heating of a feedstock in a heating chamber of a pyrolytic oven.

In preferred embodiments, gas line 1140 contains a series of perforations or orifices (not shown) directly under venturi structures 1150, which allow fuel to exit the gas line and enter venturi structures 1150, where the fuel is ignited. Some prior gas burner assemblies, such as flex-fuel burners, are capable of burning different fuel types, but require a retrofit in order to change the orifice size. For example, some prior art burners require the addition or replacement of a fuel plate to adjust the orifice size to accommodate different fuels. For example, in some prior art burners the orifice size for natural gas must be larger than the orifice size for propane. Retrofitting these burners requires the oven to be shut down in order to replace the fuel plate. One advantage of the present inventive subject matter is that the orifice size does not need to be changed. The burner assembly can dynamically adjust in real-time to accommodate different fuel types and blends of different fuel types.

As shown in FIG. 11, gas line 1140 is coupled to a flow regulator 1170. As shown in FIG. 11, only one branch of gas line 1140 is coupled to flow regulator 1170, however some embodiments, each branch of gas line 1140 is coupled to a corresponding flow regulator. Flow regulator 1170 can be any commercially viable device or mechanism for controlling the flow of gas through gas line 1140, including a control valve actuator, a pneumatic actuator, a modulating actuator, an electric actuator, a piston actuator, a direct spring acting actuator, a diaphragm actuator, radial diaphragm aperture, etc. In preferred embodiments, flow regulator 1170 is located upstream from the orifice, however, in some embodiments the flow regulator may work by constricting and expanding the orifice size. Additionally, in some embodiments gas lines 1140 may include other instrumentation for monitoring the quality, composition, or flow of the fuel, such actuators, dampers, pressure gauges, etc.

In one example, the burner assembly system is capable of dynamically adjusting to accommodate different gas fuel types. In this example, the burner assembly 1100 is coupled to a burner assembly system. The burner assembly system receives input from a temperature sensor corresponding each burner box. If the temperature corresponding with the burner box is too high, for example, the burner assembly system will decrease the flow of fuel through gas line 1140 by controlling flow regulator 1170. Because different compositions of gas fuels may burn at different temperatures at different pressures, this configuration allows burner box 1100 to accommodate different fuel types without changing the gas line orifice size.

In another example, burner box 1110 can dynamically adjust to burn various types of fuels and blends of fuels. For example, burner box 1100 may initially burn propane, however, in the process of time landfill gas (LFG) may become an available and desirable fuel source. In this case, burner box 1100 can dynamically adjust to process a mixture of propane and LFG without requiring any retrofit by adjusting flow regulator 1170 (i.e. increase or decrease the flow of fuel) to maintain a desired output temperature.

In another example, burner box 1110 can burn a fuel such as a digester gas which may have a varying composition over time as it is fed through gas line 1140. For example, the concentration of methane in the digester gas may initially be 55% then may increase to 65% over time. Because a higher methane concentration may cause the digester gas to burn at a higher temperature at the same fuel flow rate, the fuel management system can decrease the flow of digester gas through gas line 1140 via flow regulator 1170 in order to decrease the overall temperature of the pyrolytic oven.

As shown in FIG. 11, burner assembly 1100 has burner box 1110. In FIG. 11, burner box 1010 has a general rectangular shape, with four supporting walls, however, it is contemplated that burner box 1010 could have another suitable shape such as a general cube shape, a general cylindrical shape, etc. In some embodiments, burner box 1110 houses the burner assembly components such as venturi structures 1150, refractory 1120, igniter 1130, gas lines 1140, etc. As shown in FIG. 11, burner box 1110 can have a flange 1115, which couples to a pyrolytic oven via screws, bolts, rivets, studs, or similar means. This allows the burner box to be removed for repairs. In some embodiments, burner box can be welded or otherwise permanently attached to the pyrolytic oven.

In FIG. 11, burner box 1110 is lined by refractory 1120. In some embodiments, the purpose of refractory 1120 is to direct the flow of heat up toward the pyrolytic oven while minimizing the passage of heat through the walls of burner box 1110. It is contemplated that refractory 1120 may be made of a material which impedes/reflects the passage of heat including reflectors, refractors, foams, rubbers, or similar commercially viable materials. Additionally, in some embodiments, burner box 1110 includes an air intake hole (not pictured) located in the bottom of the box, which supplies the necessary oxygen for combustion.

FIG. 12 illustrates an alternative embodiment of a burner assembly 1200. Burner assembly has burner box 1210, refractory 1220, gas lines 1240, and venturi structures 1250. In some prior art burners with venturi structures, the venturi structure is incorporated in the gas line and is located upstream from the orifices. However, as shown in FIG. 12, in some embodiments of the present inventive subject matter venturi structures 1250 are located downstream from gas lines 1240. This configuration allows the flow rate to be adjusted upstream of the orifice, which allows the orifice to remain the same size for different fuel types.

In some embodiments, venturi structures 1250 are coupled directly to gas lines 1240. In other embodiments, venturi structures 1250 are connected to gas lines 1240 via a connector (not shown). The connector can adjust the height of venturi structures 1250 with respect to the pyrolytic oven. This can be done manually or dynamically as controlled by a fuel management system. For example, one way that a fuel management system could adjust the power level of a burner assembly would be to raise venturi structures 1250 so that they are closer to the heating chamber of the pyrolytic oven. The connector could be raised and lowered, or extended or shortened via servos, hydraulics, or similar means.

Figure 13A:
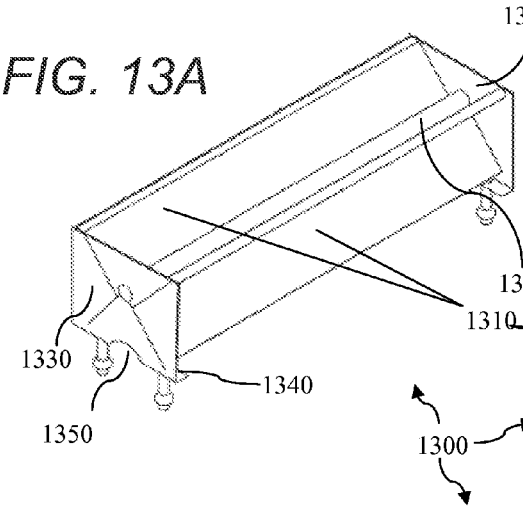
FIG. 13A is a top, right, perspective view of a venturi burner structure for a burner assembly for a pyrolytic oven.

FIG. 13A shows one embodiment of a venturi structure 1300. As used herein, the term "venturi structure" refers to a structure where the Venturi effect is utilized, specifically where a reduction of fluid pressure results when a fluid flows through a constricted section of the structure. As shown, venturi structure 1300 has side walls 1310, central pin 1320, and end caps 1330. End caps 1330 have a ledge 1340 and cutout 1350. End caps are configured to couple with a gas line via ledge 1340 and cutout 1350.

Figure 13B:
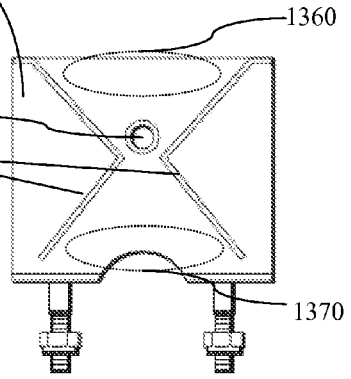
FIG. 13B is a front end view of a venturi burner structure for a burner assembly for a pyrolytic oven, the back end view being a mirror image.

FIG. 13B shows an end view of venturi structure 1300 with side walls 1310, central pin 1320, end caps 1330, lower portion 1360, and upper portion 1370. In some embodiments the gas line has a series of perforations or orifices aligned along a top surface. These perforations allow the flow of fuel from the gas line into the venturi structure. In some embodiments, side walls 1310 are L-shaped. This shape allows fuel from the gas line to mix with air in lower portion 1360 before it is combusted in upper portion 1370.

In some embodiments, lower portion 1360 is partially divided from upper portion 1370 by central pin 1320. As shown in FIG. 13, central pin spans between end caps 1330 and is disposed between side walls 1310. In some embodiments, central pin 1320 can be hollow, or in the alternative, central pin 1320 can be solid. Central pin 1320 can have a general cylindrical shape, a general rectangular shape, a general prismatic shape, or other commercially viable shape.

Figure 13C:
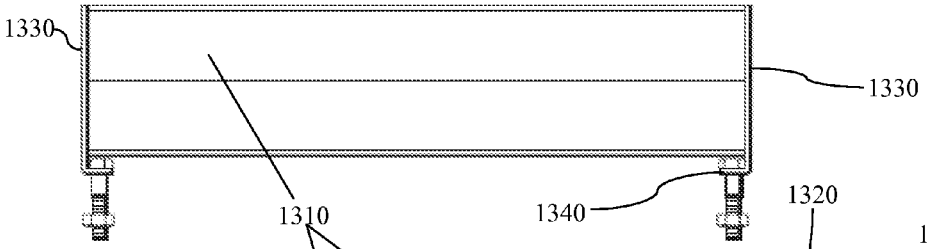
FIG. 13C is a left elevation view of a venturi burner structure for a burner assembly for a pyrolytic oven, the right elevation view being a mirror image.
Figure 13D:
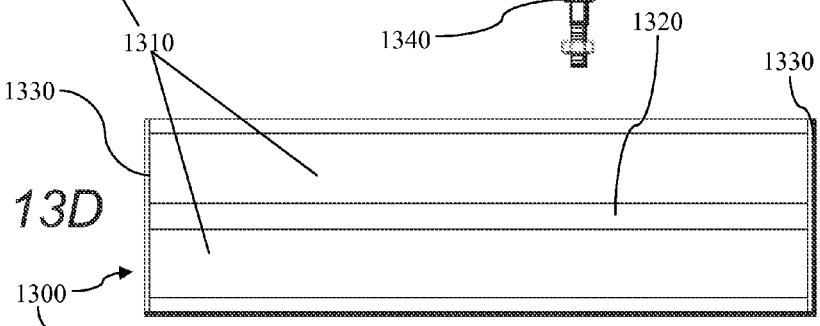
FIG. 13D is a top plan view of a venturi burner structure for a burner assembly for a pyrolytic oven
Figure 13E:
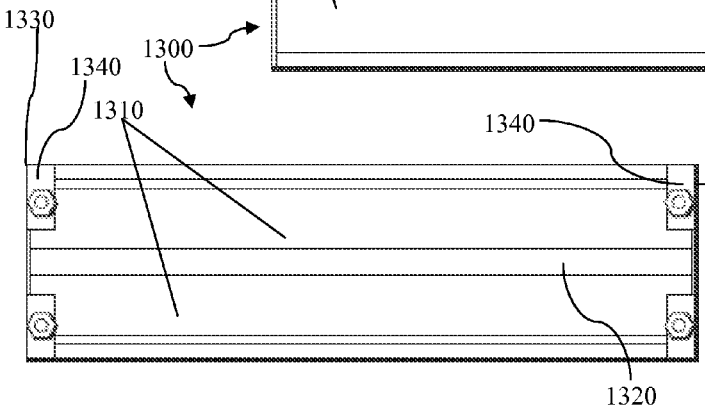
FIG. 13E is a bottom plan view of a venturi burner structure for a burner assembly for a pyrolytic oven

FIG. 13C shows a side view of venturi structure 1300 with side walls 1310, end caps 1330, and ledge 1340. FIG. 13D shows a top view of venturi structure 1300 with side walls 1310, central pin 1320, and end caps 1330. FIG. 13E shows a bottom view of venturi structure 1300 with side walls 1310, central pin 1320, end caps 1330, and ledge 1340.

Heating Chamber Supporting Structure

It is contemplated that pyrolytic ovens must be able to withstand extreme temperatures and temperature fluxes. It is also contemplated that welded joints between a heating chamber and the supporting structure can be a source of weakness in a pyrolytic oven, especially when metals with different thermal expansive properties are used. Thus, in another aspect of the inventive subject matter, a supporting structure for a heating chamber of a pyrolytic oven that remedies these weaknesses is provided. In some embodiments, the supporting structure suspends the heating chamber above the ground. In some embodiments, the supporting structure comprises a supporting platform, gussets and a wing. In these embodiments, the heating chamber is coupled to gussets, which in turn are coupled to the wing. The wing is coupled to the supporting platform. In some embodiments, the wing structure has a lip portion or flange that extends parallel along the elongated dimension of the heating chamber but does not touch the heating chamber. The lip of the wing exerts against the heating chamber at a higher pressure as the oven is heated. In preferred embodiments, the supporting structure has two wings, each on either side of the heating chamber, and each coupled to two gussets.

In some embodiments, the heating chamber, gusset, wing, and supporting platform can each be made of different metals with different thermal expansion rates. This allows the oven and the support structure to expand and contract with respect to one another as a result of temperature fluctuations. It is contemplated that different thermal expansion rates can cause stress between different materials at temperature increases of 25° F., 50° F., 100° F., 500° F., 1000° F. It is also contemplated that a combination of metal types to be used in the construction of the support structure can greatly reduce construction costs. For example, high-grade corrosion-resistant and temperature-resistant alloys may be used for the heating chamber, whereas lower-grade alloys may be used for the supporting structure.

One contemplated advantage of the contemplated inventive subject matter is that the supporting structure provides an additional means for increasing the efficiency of the oven. In some embodiments, the wing is configured to attach to the heating chamber via the lip at a point above the midpoint of the heating chamber. This configuration allows the supporting structure to support the weight of the heating chamber above the ground without impeding the heat transfer or flow of heat from the plurality of heat sources to the lower half of the heating chamber. In these embodiments, the supporting structure substantially supports the weight of the heating chamber without disrupting the airflow and heat transfer from the plurality of heat sources to the heating chamber. In some embodiments, the wing is configured to act as a heat sink to concentrate heat along the lower portion of the oven, which increases the efficiency of the oven by concentrating heat at the location of the feedstock in the oven.

Figure 14:
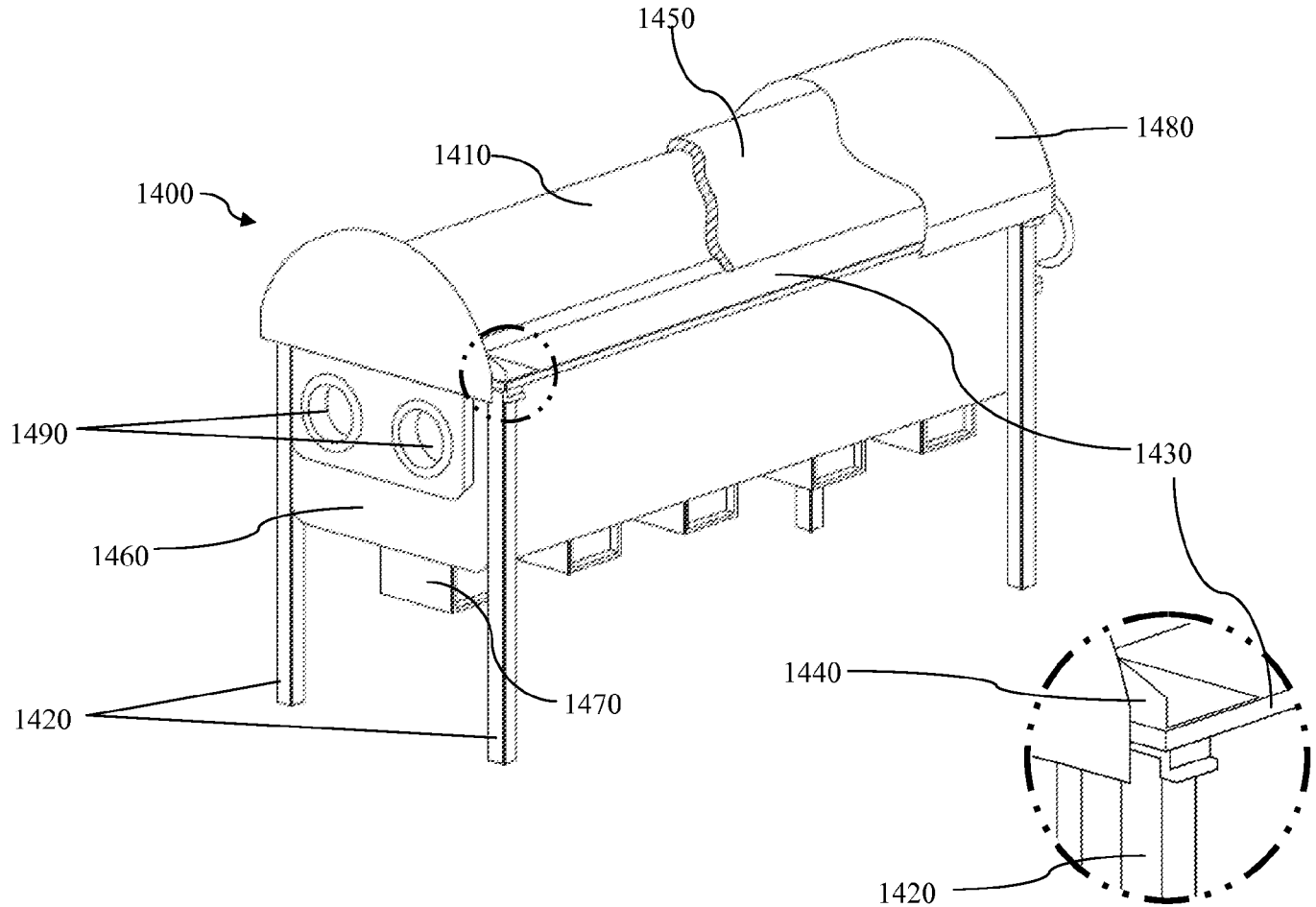
FIG. 14 is a top, left, perspective, cutaway view of a support structure for the heating chamber of a pyrolytic oven.

FIG. 14 illustrates a pyrolytic oven assembly 1400 with such a supporting structure. As shown, pyrolytic oven assembly 1400 includes heating chamber 1410, supporting platform 1420, wing 1430, front gussets 1440, insulator 1450, tray 1460, heat source 1470, lid 1480, and conveyor holes 1490.

It is contemplated that welds can be a source of weakness between different components in the construction of pyrolytic ovens because of thermal expansion and contraction as a result of temperature fluctuation. Additionally, it is contemplated that welds between two different types of metal alloys are structurally inferior to welds between the same metal alloy. Thus, in some embodiments, heating chamber 1410 is coupled to front gussets 1440 via screws, bolts, rivets, studs, or similar means. Coupling in this manner eliminates the need for welds and accommodates for some movement between heating chamber 1410 and front gussets 1440 in respect to one another as a result of thermal expansion or retraction. Similarly, in some embodiments, front gussets 1440 are also coupled to wing 1430 also via screws, bolts, rivets, studs, or similar means. Coupling in this manner allows the heating chamber, the gussets, and the wing to comprise different materials. Allowing the use of different materials for each component can greatly decrease the cost of the pyrolytic oven because lower-quality materials (and generally less-expensive) can be used in the supporting structure, whereas higher-quality (and generally more expensive materials) can be used for the heating chamber.

Wing 1430, in some embodiments, spans substantially across the elongated length of heating chamber 1410. "Spans substantially" means that wing 1430 spans preferably between 70%-100% of the elongated length of heating chamber 1410, more preferably between 80-100% of the elongated length of heating chamber 1410, and most preferably between 90-100% of the elongated length of heating chamber 1410. Unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary.

It is contemplated that wing 1430 can be coupled to supporting platform 1420 via screws, bolts, rivets, studs, or similar means. Thus, the weight of heating chamber 1410 is substantially supported by supporting platform 1420. "Substantially supported" means at least 50% of the weight of heating chamber 1410 is supported by the supporting platform 1420 and tray 1460. In FIG. 14, four posts are shown, but other embodiments contemplate the use of more or less posts and more or less flanges. This configuration allows for heating chamber 1410 to thermally expand vertically or horizontally. In preferred embodiments, the supporting structure comprises at least two wings with corresponding gussets.

In some embodiments, one of the ends along the elongated dimension of the pyrolytic oven assembly 1400 is affixed to a structure (e.g., a permanent structure) of an enclosure (e.g., a building) for the pyrolytic oven. This way, as the pyrolytic oven assembly 1400 and its components (e.g., heating chamber 1410, supporting platform 1420, wing 1430, front gussets 1440, etc.) expands due to heat (and it is contemplated that the different components may expand at a different rate and scale due to their respective material compositions), the pyrolytic oven assembly 1400 and its components is forced to expand along one direction (e.g., towards the end that is not affixed to the structure). The pyrolytic oven assembly 1400 in some cases can expand up to 6 inches or more.

Figure 15:
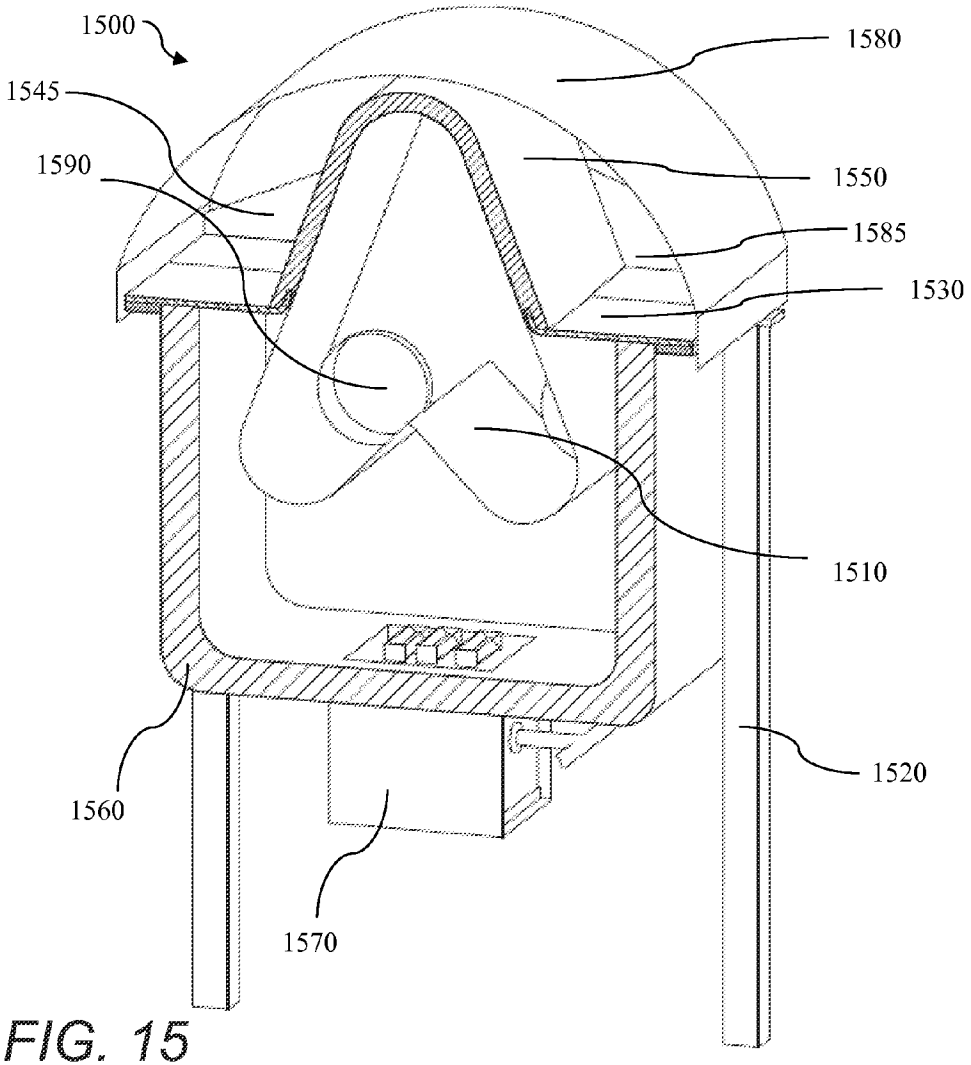
FIG. 15 is a cutaway view of a support structure for the heating chamber of a pyrolytic oven.

FIG. 15 illustrates a cutaway view of the rear end of a support system for a pyrolytic oven. This view shows additional elements of the support system. As shown in FIG. 15, pyrolytic oven assembly 1500 includes heating chamber 1510, supporting platform 1520, wing 1530, rear gussets 1545, insulator 1550, tray 1560, heat source 1570, lid 1580, cavity 1585, and conveyor holes 1590. Preferred embodiments of a support system for a pyrolytic oven have both front gussets 1440, as shown in FIG. 14, and rear gussets 1545, as shown in FIG. 15.

Additionally or alternatively, in preferred embodiments, front gussets 1440 and rear gussets 1545 are attached to heating chamber 1510 at a point above the midpoint of heating chamber 1510, such that there is no supporting structure between the midpoint of heating chamber 1510 and tray 1560 so that there is a cavity 1585 between the bottom of heating chamber 1510 and tray 1560. This allows air and heat to circulate freely within this cavity 1585 and further concentrates the heat on the lower portion of heating chamber 1510. In preferred embodiments, cavity 1585 is hollow and sealed off from the lower portion of heating chamber 1510. However, in some embodiments this cavity may not be hollow and may contain additional heat sources or additional insulation. Additionally, in some embodiments cavity may be open to the lower portion of heating chamber 1510.

In some embodiments, the supporting structure includes an insulator 1550. In some embodiments, insulator 1550 comprises a vitrous aluminosilicate ceramic fiber thermal blanket, such as Durablanket® or Fiberfrax®, manufactured by Unifrax LLC. However, insulator 1550 may be any commercially viable material which impedes the passage of heat including reflectors, ceramic fibers, refractors, foams, rubbers, etc. In some embodiments, insulator 1550 is located along the top half of heating chamber 1510. In some embodiments, insulator 1550 and wing 1530 are configured to retain heat in the lower portion of heating chamber 1510. This allows heat to be concentrated along the bottom of heating chamber 1510 so that maximum heat is transferred from heating chamber 1510 to the feedstock. The remainder of heating chamber 1510 is heated through heat transfer through the walls of heating chamber 1510.

Figure 16A:
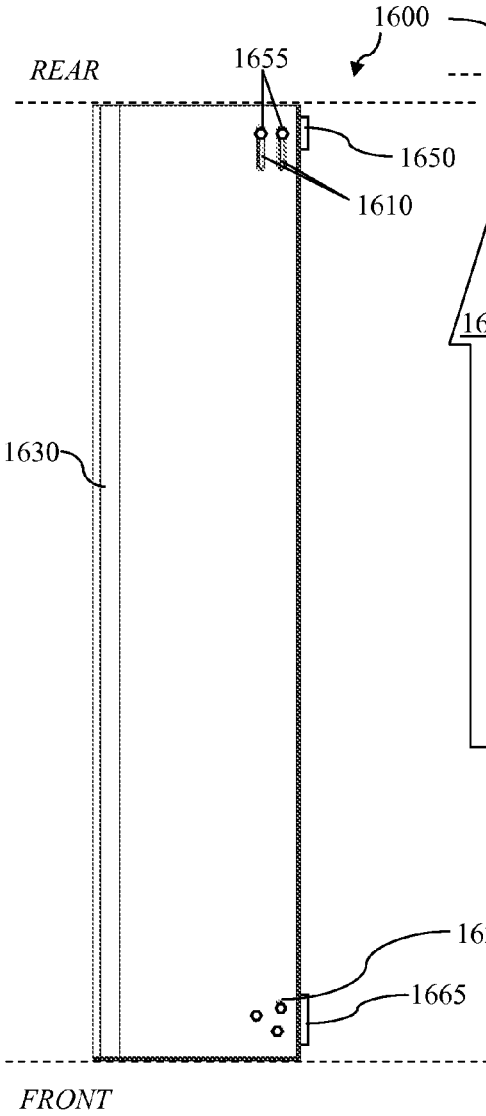
FIG. 16A is a top plan view of a wing of a support structure for the heating chamber of a pyrolytic oven in a first position.

FIG. 16A illustrates wing 1600 of a support structure for a pyrolytic oven in a first position. As shown, wing 1600 has lip 1630, slots 1610, and holes 1620. In some embodiments, wing 1600 couples to supporting platform 1650 at slots 1610 and holes 1620 via bolts 1655. However, wing 1600 may also be coupled to supporting platform via screws, rivets, studs, or similar means. In some embodiments, holes 1620 are located toward the front of wing 1600, whereas slots 1610 are located toward the rear of wing 1600, although the reverse may be true. In some embodiments wing 1600 can have two sets of slots and no holes.

As mentioned before, it is contemplated that different materials expand at different rates when exposed to heat. This can cause mechanical stress on a pyrolytic oven made of multiple materials. Thus, in some embodiments the front portion of wing 1600 is fixed to supporting platform 1650 at holes 1620. Slots 1610 allow wing 1600 to expand a long a horizontal dimension (1690) when heated. This configuration ensures that the front of wing 1600 remains fixed while the rear is allowed to expand horizontally when the temperature increases. This allows the wing and supporting platforms to expand at different rates while minimizing the mechanical stress on each individual component.

Figure 16B:
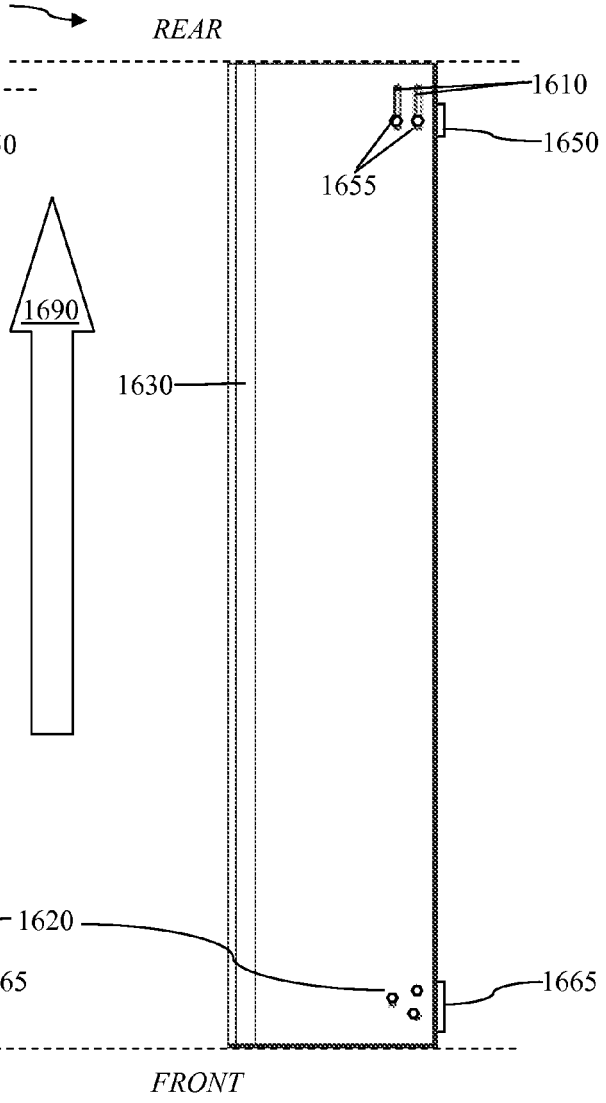
FIG. 16B is a top plan view of a wing of a support structure for the heating chamber of a pyrolytic oven in a second position.

FIG. 16B illustrates wing 1600 in a second position as a result of thermal expansion once heat has been applied. As shown in FIG. 16B, the front of wing 1600 is fixed when compared with FIG. 16A, but the rear of wing 1600 has expanded horizontally in direction 1690 with respect to FIG. 16A.

Figure 16C:
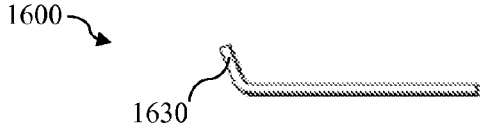
FIG. 16C is a front end view of a wing of a support structure for the heating chamber of a pyrolytic oven, the back end view being a mirror image.

FIG. 16C shows a front end view of wing 1600 showing lip 1630. In some embodiments, when the pyrolytic oven is in a cooled state, lip 1630 does not substantially touch the heating chamber. However, when heated, lip 1630 expands to touch the heating chamber. This allows for additional support as a result of the coupling of lip 1630 and the heating chamber as the oven is heated. It is contemplated that the weight of a heating chamber will increase as feedstock is added. Thus, in some embodiments, the additional support as a result of the coupling of lip 1630 and the heating chamber when the oven is heated is beneficial especially when the oven is on and in use.

Figure 17:
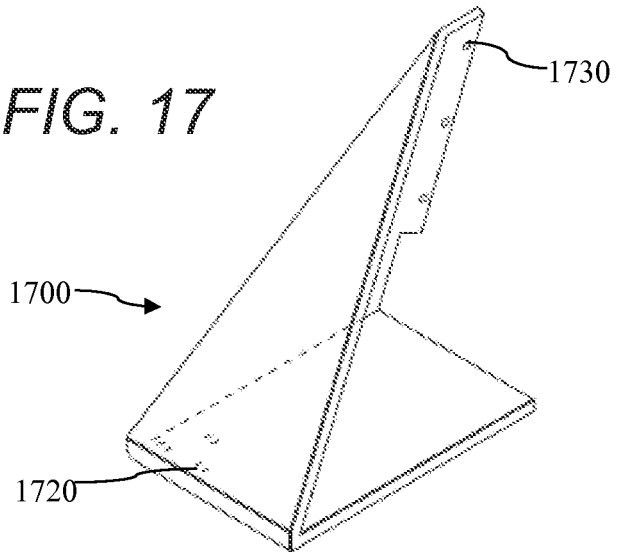
FIG. 17 shows a top, left, perspective view of a front gusset of a support structure for supporting the heating chamber of a pyrolytic oven.
Figure 18:
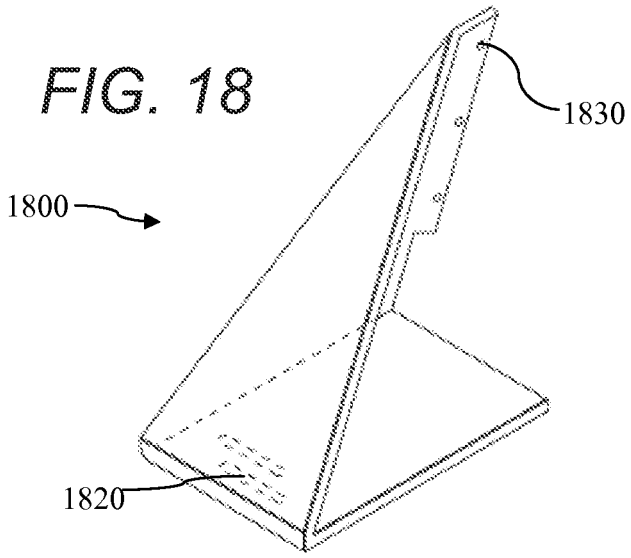
FIG. 18 shows a top, left perspective view of a rear gusset of a support structure for supporting the heating chamber of a pyrolytic oven.

FIG. 17 illustrates front gusset 1700. In some embodiments, front gusset 1700 has wing holes 1720 and heating chamber holes 1730. In some embodiments, front gusset 1700 couples with wing 1600 via wing holes 1720 and to the heating chamber via heating chamber holes 1730. FIG. 18 shows rear gusset 1800, which in some embodiments has wing slots 1820 and heating chamber holes 1830. Rear gusset 1800 couples with wing 1600 via wing slots 1020 and to heating chamber 1410 via heating chamber holes 1830.

Interlocking Heating Chamber Panels

It is contemplated that a heating chamber of a pyrolytic oven may be exposed to temperature extremes and fluctuations, and that these variable conditions can impact the structural integrity of the heating chamber. Thus, in one aspect of the inventive subject matter, a heating chamber with multiple interlocking panels is provided. Additionally, it is contemplated that the use of multiple panels allows the heating chamber to be more easily repaired because each panel can be replaced independently, which significantly decreases repair costs. In some embodiments, the heating chamber has one panel with a tongue along its edge and a corresponding panel with a groove along its edge. In these embodiments, the tongue and groove are sized and dimensioned to couple both panels together.

Figure 19A:
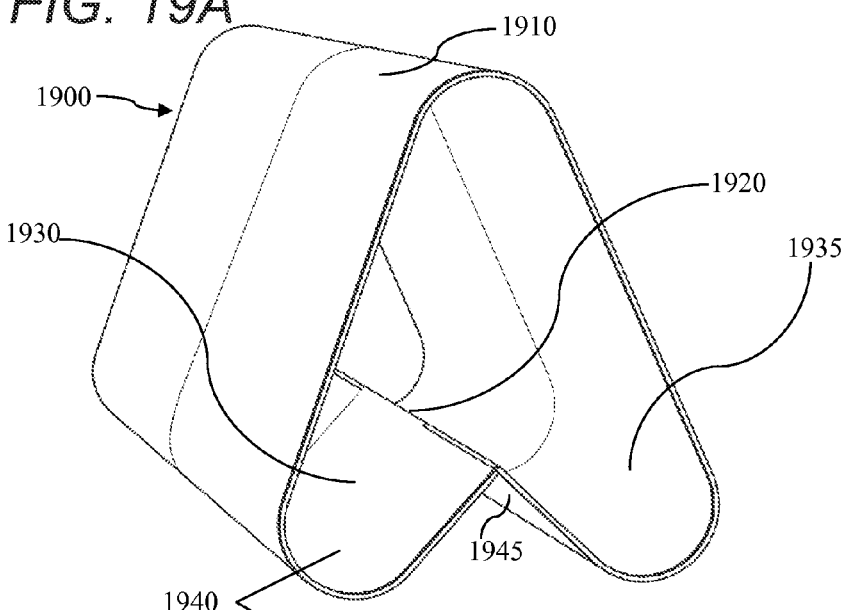
FIG. 19A is a top, left, perspective view of a heating chamber of a pyrolytic oven with multiple panels.

FIG. 19A illustrates a reverse heart shaped heating chamber 1900 having such a tongue and groove interlocking mechanism. Heating chamber 1900 has outer ridge 1910, inner ridge 1920, feedstock troughs 1930 and 1935 and multiple panels, including panel 1940 and panel 1945. Panel 1940 and 1945 are coupled at inner ridge 1920. The reverse heart shape allows for more efficient heating and mixing of the feedstock. In other embodiments, the heating chamber can have the general shape of a cylinder, rectangle, a prism, a trapezoid, or other commercially viable shape that allows for the processing of a feedstock. In FIG. 24, heating chamber 1900 is configured to receive a screw auger or conveyor for each feedstock trough. In some embodiments, the heating chamber may have one or more feedstock troughs, corresponding with one or more screw augers or conveyors.

In some embodiments, heating chamber 1900 is made of a high-temperature corrosion-resistant metal alloy that can be casted or fabricated. Some contemplated alloys include highly corrosion-resistant nickel-chromium-molybdenum alloys such as RA 602 CA©, RA 333©, HR-120©, HR-160©, Hastelloy© X Alloy, etc. However, other commercially viable metal alloys can be used. In addition, the heating chamber may be partially or completely made of ceramic, glass, concrete, brick, or other temperature-resistant and corrosion-resistant material.

As referred to herein, "tongue" means a projecting portion built into a material that fits into a groove built into another material. As referred to herein, "groove" means a cut, indentation, depression, channel, or notch built into a material.

Figure 19B:
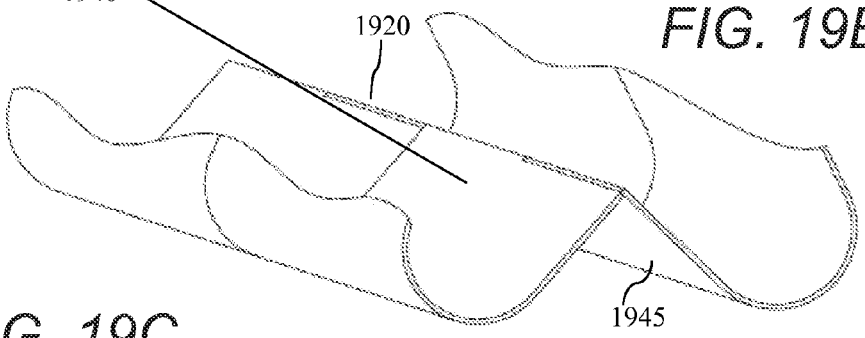
FIG. 19B is a top, left, perspective view of the lower panels of the heating chamber of a pyrolytic oven, showing an interlock of the tongue and groove structures of the lower panels.

FIG. 19B is a cutaway view of heating chamber 1900, illustrating panel 1940 and panel 1945, which are coupled at inner ridge 1920 to form an interlock. It is contemplated this coupling is stronger and more durable than conventionally constructed heating chambers because panels 1940 and 1945 can expand and shift with respect to one another as heating chamber 1900 is heated and cooled, which increases the durability of the heating chamber. Also, in some embodiments, panels 1940 and 1945 can be coupled without requiring a weld. However, in other embodiments, panels 1940 and 1945 can be welded together. Another contemplated advantage is that panels 1940 and 1945 can be easily replaced if one panel is damaged or needs repair.

Figure 19C:
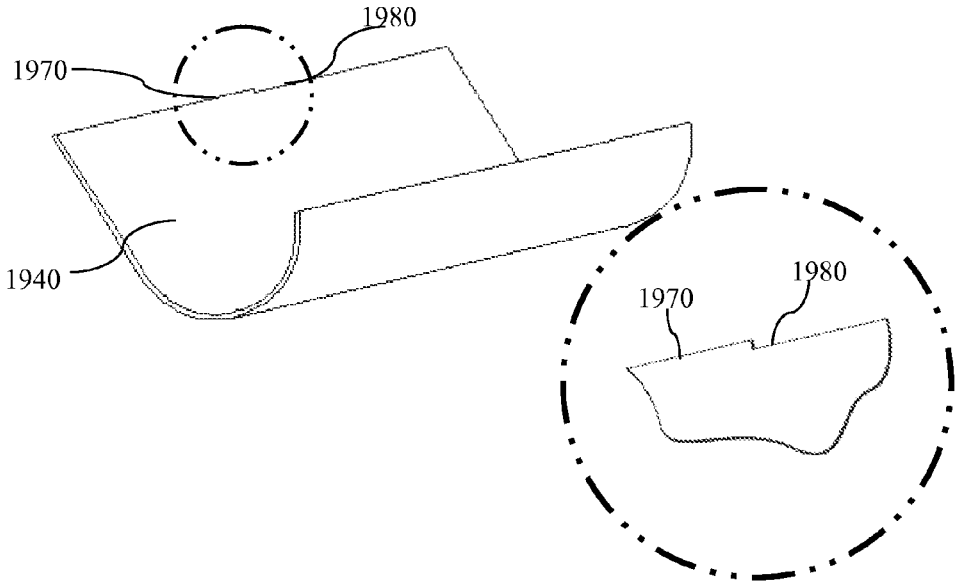
FIG. 19C is a left elevation view of a lower panel of the heating chamber of a pyrolytic oven having an inner tongue and groove structure.

FIG. 19C illustrates panel 1940 of heating chamber 1900 showing tongue 1970 and groove 1980. In some embodiments, tongue 1970 and groove 1980 are configured to interlock with one another, so that the groove of one panel is sized and dimensioned to receive a tongue of another panel. In some contemplated embodiments, the depth of tongue 1970 is substantially identical to the width of a second panel (such as panel 1945, not shown in FIG. 26), such that when panel 1940 and panel 1945 are coupled, their surfaces are substantially aligned or flush. "Aligned or flush" means that the surfaces are parallel with one another within preferable 15 degrees, more preferably 10 degrees, and most preferably within 5 degrees. "Substantially identical" means that the dimensions are similar within 5 inches, more preferably 1 inch, and most preferably within 0.5 inches.

In some embodiments, panel 1940 contains a tongue 1970 but no groove. In this embodiment, the corresponding panel 1945 would contain a groove sized and dimensioned to receive tongue 1970. In some embodiments, the non-tongue and non-groove portions of the edges of panels 1940 and 2245 are angled to meet one another without an interlock.

In preferred embodiments, tongue 1970 and groove 1980 of panel 1940 have the same length such that each span 50% of a length of the panel. However, in some embodiments, the lengths of tongue 1970 and groove 1980 are different, provided that both tongue 1970 and groove 1980 are sized and dimensioned to mate with a corresponding tongue and groove on panel 1940. In some embodiments, panels 1940 and 1945 have multiple tongues and multiple grooves. Additionally, in some embodiments, heating chamber 1900 comprises multiple lower panels.

Although the above description illustrates the different inventive subject matters being applied to a pyrolytic oven, a person who is skilled in the art would appreciate that the same inventive subject matters can also be applied to different types of ovens (e.g., cooking ovens, kilns, paint drying ovens, etc.) to achieve the same benefits.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps can be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A fuel management system for a pyrolytic oven configured to combust feedstock to generate fuel, comprising:

an elongated heating chamber comprising a first zone and a second zone, wherein the first zone comprises a portion along the elongated dimension of the heating chamber that is distinct from the second zone;

a first set of sensors configured to monitor a temperature and a composition of the feedstock in the first zone;

a second set of sensors configured to monitor a temperature and a composition of the feedstock in the second zone;

a conveyor configured to carry the feedstock through the elongated heating chamber;

a plurality of independently controllable heat sources comprising a first heat source configured to supply heat to the first zone and a second heat source configured to supply heat to the second zone; and a fuel management engine communicatively coupled with the first and second sets of sensors, the conveyor, and the plurality of independently controllable heat sources, and programmed to:

retrieve temperature data and feedstock composition data from the first and second set of sensors, generate a first feedstock profile based on temperature data and feedstock composition data retrieved from the first set of sensors, generate a second feedstock profile based on temperature data and feedstock composition data retrieved from the second set of sensors, re-configure the first heat source based in part on the first feedstock profile, re-configure the second heat source based in part on the second feedstock profile, re-configure the conveyor based in part on the first and second feedstock profiles.

2. The fuel management system of claim 1, wherein the fuel management engine is further programmed to independently control the plurality of heat sources and to re-configure the conveyor by dynamically adjusting a speed of the conveyor.

3. The fuel management system of claim 2, wherein the fuel management engine is further programmed to re-configure the first and second heat sources by adjusting a power for each of the first and second heat sources based in part on the first and second feedstock profile, respectively.

4. The fuel management system of claim 1, wherein the first set of sensors comprises at least a temperature sensor and a spectroscopic sensor.

5. The fuel management system of claim 1, wherein the fuel management engine is further programmed to:

determine a first power level for the first heat source as a function of the first feedstock profile; and determine a second power level for the second heat source as a function of the second feedstock profile.

6. The fuel management system of claim 5, wherein the first power level is different from the second power level.

7. The fuel management system of claim 1, wherein the first and second zones are inter-connected with each other.

8. The fuel management system of claim 1, wherein the plurality of heat sources is disposed below the heating chamber.

9. The fuel management system of claim 1, wherein the plurality of heat sources comprises at least a gas burner and an electrical burner.

* * * * *